US009138368B2

(12) United States Patent
Yamamoto

(10) Patent No.: US 9,138,368 B2
(45) Date of Patent: Sep. 22, 2015

(54) JOINT MOTION FACILITATION DEVICE

(76) Inventor: Keijirou Yamamoto, Kanagawa (JP)

( * ) Notice: Subject to any disclaimer, the term of this patent is extended or adjusted under 35 U.S.C. 154(b) by 1179 days.

(21) Appl. No.: 13/010,250

(22) Filed: Jan. 20, 2011

(65) Prior Publication Data

US 2011/0118635 A1 May 19, 2011

Related U.S. Application Data

(63) Continuation of application No. PCT/JP2010/058013, filed on May 12, 2010.

(30) Foreign Application Priority Data

Oct. 5, 2009 (JP) ..... 2009-231532

(51) Int. Cl.
*A61H 1/00* (2006.01)
*A61H 1/02* (2006.01)

(52) U.S. Cl.
CPC ..... *A61H 1/02* (2013.01); *A61H 1/0237* (2013.01); *A61H 1/0262* (2013.01); *A61H 1/0274* (2013.01); *A61H 2201/5056* (2013.01)

(58) Field of Classification Search
CPC ..... A61H 1/00; A61H 1/02; A61H 1/0237; A61H 1/024; A61H 1/0244; A61H 1/0255; A61H 1/0285; A61H 9/00; A61H 9/0078; A61H 1/0262; A61H 1/0274; A61H 2001/00; A61H 2201/0103; A61H 2201/1238; A61H 2201/1409; A61H 2201/5056; A61H 2005/067
USPC ..... 601/5, 6, 9, 11, 23, 26, 27, 29, 33, 34, 601/35, 84, 86, 88, 96, 97, 98, 103, 104, 601/105, 148–152; 602/13; 128/DIG. 20
See application file for complete search history.

(56) References Cited

U.S. PATENT DOCUMENTS 4,766,612 A * 8/1988 Patton, Sr. ..... 2/16
5,333,605 A 8/1994 Matsumura (Continued)

FOREIGN PATENT DOCUMENTS

EP 1138286 A3 * 8/2002 ..... A61F 2/50
JP 5-91653 12/1993

(Continued)

OTHER PUBLICATIONS

N. Tsujiuchi, et al.; "Modeling of Pneumatic Artificial Actuator and Joint Control;" Dynamics and Design Conference 2008 CD-ROM; Sep. 2, 2008; pp. 331-1-331-6 and 3 end sheets (9 Sheets)/Cited in International Search Report.

(Continued)

*Primary Examiner* — Quang D Thanh
(74) *Attorney, Agent, or Firm* — Kratz, Quintos & Hanson, LLP

(57) ABSTRACT

When air is supplied by an air pressure regulation part to bellows 211 through 213 of finger joint motion facilitation parts $\mathbf{110}_j$ (where j=1, . . . , 5), the bellows 211 through 213 expand approximately in the shape of circular arcs, since annular grooves on the side of the bellows 211 through 213 opposing a joint are elastically restrained by elastic members 241 through 243. Due to this, the bellows 211 through 213 cooperate, and exert force in the rotational direction to flex the first through the third joints of a finger from their extended states. Next, when air is exhausted from the bellows by the air pressure regulation part, the bellows 211 through 213 contract. Due to this, the bellows 211 through 213 cooperate, and exert force in the rotational direction to extend the first through the third joints of a finger from their flexed states. The forces generated in this manner are transmitted to the joints by transmission members 231 through 234. As a result mounting becomes simple, and also it is possible to facilitate sufficient joint movement for each joint.

20 Claims, 15 Drawing Sheets

(56) References Cited

U.S. PATENT DOCUMENTS

| | | | | |
|---|---|---|---|---|
| 5,562,105 | A * | 10/1996 | Syrop et al. | 128/845 |
| 6,312,400 | B1 * | 11/2001 | Itikawa et al. | 601/100 |

FOREIGN PATENT DOCUMENTS

| | | | |
|---|---|---|---|
| JP | 11-397 | | 1/1999 |
| JP | 2000-51289 | | 2/2000 |
| JP | 2002-103270 | A1 | 4/2002 |
| JP | 2002-345861 | A1 | 12/2002 |
| JP | 2004-267254 | A1 | 9/2004 |
| JP | 2006000294 | A | 1/2006 |
| JP | 3124829 | U | 8/2006 |
| JP | 2006-340852 | A1 | 12/2006 |
| JP | 3941328 | B2 | 7/2007 |
| JP | 2007-275486 | A1 | 10/2007 |
| JP | 2007-282991 | A1 | 11/2007 |
| JP | 2009-219648 | A1 | 10/2009 |

OTHER PUBLICATIONS

N. Tsujiuchi, et al.; "Development and Control Performance of Pneumatic Actuator Driven by Low Pressure;" Transactions of the Japan Society of Mechanical Engineers.C; vol. 73; No. 732; Aug. 25, 2007; pp. 2320-2326 (7 Sheets)/Cited in International Search Report.

M. Ishii, et al.; "Development of Power Assist Suit—Development of wrist units and improvement of waist unit;" Dynamics and Design Conference 2006 CD-ROM; Aug. 6, 2006; pp. 603-1-603-4 and 1 end sheet (5 Sheets)/Cited in International Search Report.

Japanese International Search Report for International Application No. PCT/JP2010/058013 dated Jul. 26, 2010.

Supplementary European Search Report and communication dated Oct. 13, 2014 for European Application No. EP 10790713.1.

* cited by examiner

JOINT MOTION FACILITATION DEVICE

RELATED APPLICATION

This is a continuation application of the international patent application No. PCT/JP2010/058013 filed with Application date: May 12, 2010. The present application is based on, and claims priority from, J.P. Application 2009-231532, filed on Oct. 5, 2009, the disclosure of which is hereby incorporated by reference herein its entirety.

BACKGROUND OF THE INVENTION

The present invention relates to a joint motion facilitation device, and more particularly relates to a joint motion facilitation device that facilitates joint motion of a predetermined subject body portion.

BACKGROUND ART

From the past, devices of various kinds have been introduced for use in rehabilitation. Among devices of this type, there are ones that replace a physiotherapist in facilitation treatment with physical exercises and motion, with the goal of recovery of the fundamental operation of the patient.

One such device that facilitates motion of the patient is a device that facilitates finger joint motion (refer to Patent Document #1, denoted hereinafter as the "prior art") when one or more fingers have suffered paralysis and contracture or the like due to a central nervous difficulty such as a cerebral infarction or the like. In the technique of this prior art example, a facilitation device holds the joints of the patient in a closed chamber that contains a resilient foam portion. And then the foam portion is caused to contract by lowering the air pressure in this closed chamber, thus exerting forces upon the joints and moving or flexing the joints from their original positions. Subsequently the foam portion is caused to expand by releasing the lowered pressure in the closed chamber, so that again forces are exerted upon the joints and the joints are moved or flexed so as to be returned to their original positions.

Patent Document #1: Japanese Patent Publication 2002-513299.

SUMMARY OF THE INVENTION

With the technique of the prior art example described above, the joints of the fingers are moved or flexed by contraction and expansion of a single foam portion. The use of a single actuator in this manner for providing motion for all of the joints of a plurality of fingers is not really a method well adapted for providing flexion and extension motion of several fingers. In particular, since the joints of the thumb flex around rotational axes whose directions are different from those of the joints of the other four fingers, with the technique of this prior art example, not only is it not possible to facilitate joint motion of the thumb, but also it is possible that force may be exerted in an improper direction that is different from the direction of thumb flexion.

Furthermore since the technique of the prior art example is adapted for the fingers to be inserted into the device in the state in which the fingers are extended, for a patient for whom opening and closing his fingers by his own efforts is difficult, such as a patient who has already suffered finger contracture or the like, it becomes difficult to put his fingers into the device. Moreover, in the case of a patient who has broken a bone in one finger, with the technique of the prior art example, the joints of all of the fingers are moved or flexed irrespective of whether or not rehabilitation of the finger in which the bone is broken by simple joint motion is sufficient or appropriate. Yet further, with the technique of the prior art example, if the amount of pressure reduction in the closed chamber is insufficient, then the limits for joint motion become restricted, and sufficient joint motion cannot be obtained.

Due to the above problems, a technique has been eagerly desired with which fitting is easy when joint motion of a patient is to be facilitated, and moreover with which the limits of joint motion do not become restricted, so that it is possible to facilitate joint motion as required by the patient. To satisfy the above requirement is considered to be one problem which the present invention should solve.

The present invention has been conceived in the light of the considerations described above, and takes as its object to provide a joint motion facilitation device that, along with being capable of easy fitting, can also facilitate sufficient joint motion for each joint.

The present invention is a joint motion facilitation device that facilitates the motion of one or more joints of a predetermined subject body portion, characterized by comprising: at least one bellows that can expand and contract freely, provided for each joint in said predetermined subject body portion for which joint motion is to be facilitated, and generating force to facilitate said joint motion when provided to a joint portion in a direction perpendicular with respect to the rotational axis of rotation motion of said joint; a conduit that communicates with said bellows; transmission members connected to end portions of said bellows, that, when mounted to said predetermined subject body portion, transmit force originating in expansion and contraction of said bellows to said joint for facilitating said joint motion; and mounting portions that mount said bellows and said transmission members to said predetermined subject body portion.

With this joint motion facilitation device, along with arranging, by the mounting portion, the bellows provided for each joint of the predetermined subject body portion for which joint motion is to be facilitated at its corresponding joint portion and in the direction that is perpendicular with respect to the rotational axis of rotational motion of the joint, also the transmission members that are connected to the end portions of the bellows are mounted to the predetermined subject body portion. Due to this, it is possible to install the joint motion facilitation device of the present invention to the predetermined subject body portion, irrespective of whether the joint of the predetermined subject body portion is in its extended state or in its flexed state. Moreover, when the air pressure in the bellows that is communicated with the conduit changes, the bellows expands and contracts, and thus the bellows generates force to facilitate joint motion. And the transmission members transmit this force for facilitating joint motion to the joint. As a result, joint motion of the predetermined subject body portion is performed passively.

Thus, according to the joint motion facilitation device of the present invention, along with installation being simple, it is also possible to facilitate sufficient joint motion for each joint. It should be understood that it is possible to perform joint motion without imposing any great burden upon the predetermined subject body portion due to the weight of the device and so on, provided that the bellows used are made from resin which is light in weight and also soft. Here the "predetermined subject body portion" may be the body of a human subject, or may be some subject body portion other than the body of a human subject, that has a joint mechanism.

And the joint motion facilitation device according to the present invention may further comprise an air pressure regulation part that regulates said air pressure in the bellows via said conduit. In this case, since the air pressure in the bellows is regulated by the air pressure regulation part, accordingly it is possible to facilitate joint motion due to the force generated according to this regulation of the air pressure. Here, said air pressure regulation part may perform supply of air to said bellows and exhaustion of air from said bellows. In this case, due to the positive and negative torque that are generated when air is supplied to the bellows and when air is exhausted from the bellows, the bellows is able to generate force to facilitate joint motion in different rotational directions.

And, with the joint motion facilitation device according to the present invention, there may further be included a detection part that detects bio-monitoring information related to a muscle that drives said joint, with said air pressure regulation part regulating the air pressure in said bellows on the basis of the result of detection by said detection part. In this case, the force expressed by a muscle that drives the joint may be derived on the basis of bio-monitoring information related to the muscle, and the air pressure in the bellows may be regulated on the basis of the result of this derivation. Here, an electromyogram, the muscle hardness, or an electroencephalogram or the like may be employed as this bio-monitoring information.

Moreover, with the joint motion facilitation device according to the present invention, said bellows may have annular grooves provided at regular intervals, and the structure may further include a restraining member that elastically restraints the annular grooves on the side of said bellows that faces said joint. In this case, when the joint is in its flexed state, the gaps of the annular grooves of the bellows on its side that faces the joint are pinched down as compared to the gaps of the annular grooves on the opposite facing side, but the restraining member adjusts the gaps of the annular grooves on that facing side correspond to the flexed state and to the extended state of the joint. Due to this, it is possible to absorb the expansion and contraction of the distance across the joint that takes place along with joint motion such as flexion motion and extension motion and so on.

Furthermore, with the joint motion facilitation device of the present invention, said bellows may be made so that the gaps between annular grooves that are provided at regular intervals along its expansion and contraction direction change continuously around the circumferential direction, and so that said gaps between said annular grooves are shorter on the side that faces said joint portion. In this case, even if the above described restraining member is not provided, still the bellows can correspond to the flexed state and to the extended state of the joint. Due to this, the joint motion facilitation device is able to absorb expansion and contraction of the distance across the joint along with joint motion, in a similar manner to when the restraining member is additionally provided.

Said transmission members may be fittable to and detachable from said bellows. In this case, by preparing transmission members that are matched to the length of the distance across the joint of the predetermined subject body portion (for example, the body of a human subject), it is possible to supply a device that is matched to the skeleton and so on of a predetermined subject body portion, to that predetermined subject body portion.

And, with the joint motion facilitation device according to the present invention, said joints of said predetermined subject body portion may be at least a single joint of a finger, and said bellows may be disposed upon the extension side of said joint. In this case, it is possible to facilitate the joint motion of the finger, which is the predetermined subject body portion. Moreover, since the bellows are installed at the extension sides of the joints, which, as contrasted with the flexion sides of the joints, are the sides where no hindrance will be imposed upon the motion of the joints of the predetermined subject body portion, accordingly it is possible to ensure good joint movability, and it is possible to ensure that no hindrance is imposed upon the motion of the joints of the predetermined subject body portion.

If the joints of the predetermined subject body portion are the joints of a finger, then it may be arranged for bellows that are provided for each of a plurality of joints of the same finger to operate together so as simultaneously to generate forces in a first rotational direction directed from the flexed state to the extended state, or forces in a second rotational direction directed from the extended state to the flexed state. In this case, by these bellows operating together, it is possible to facilitate flexion and extension motion of the finger, for all of the plurality of joints of that finger for which joint motion is to be facilitated. Furthermore, if the joints of the predetermined subject body portion are the joints of a finger, then a plurality of said bellows may be provided, and there may be further included a selection part that selects bellows, among said plurality of bellows, whose air pressure can be regulated. In this case, only that one or more bellows selected by the selection part generates force for facilitating joint motion. Due to this, it is possible selectively to facilitate joint motion for each desired joint of the finger that is the predetermined subject body portion.

Furthermore, with the joint motion facilitation device of the present invention, said joint of said predetermined subject body portion may be a wrist joint, and said bellows may be disposed upon at least one of the flexion side and the extension side of said wrist joint. In this case, it is possible to facilitate the joint motion of the wrist, which is the predetermined subject body portion. Here, if the joint of the predetermined subject body portion is the joint of a finger or the wrist, then said mounting portion may be a glove upon which said bellows that is connected to said transmission members is disposed at a position corresponding to said joint. In this case, simply by fitting this glove upon the predetermined subject body portion, along with the bellows being disposed at their corresponding joint portions in directions that are perpendicular with respect to the axes of rotation of the rotational motions of the joints, also the transmission members that are connected to the end portions of the bellows are installed upon the predetermined subject body portion. Due to this, for example, it is easy to install this device upon a predetermined subject body portion of which the joints, such as the joints of the fingers or the like, have not suffered contracture.

Moreover, with the joint motion facilitation device of the present invention, said joint of said predetermined subject body portion may be at least one of an elbow joint, a shoulder joint, a knee joint, and an ankle joint, and it may be arranged for said bellows to be disposed upon at least one of the flexion side and the extension side of said at least one joint. In this case, it is possible to facilitate the joint motion of the elbow, the shoulder, the knee, or the ankle, which is the predetermined subject body portion. And, with the joint motion facilitation device of the present invention, said joint of said predetermined subject body portion may be a hip joint, and it may be arranged for said bellows to be disposed upon the flexion side of said hip joint. In this case, it is possible to facilitate the joint motion of the hip, which is the predetermined subject body portion.

Said mounting portion that installs the bellows and the transmission members described above to the predetermined subject body portion may be made to include a fastening member that is disposed to said transmission member and that is fastened around said predetermined subject body portion. In this case, only by fastening this fastening member in a predetermined position to the predetermined subject body portion, along with the bellows being positioned at its corresponding joint portion in a direction that is perpendicular with respect to the rotational axis of the rotational motion of the joint, also the transmission member connected to the end portion of the bellows is installed to the predetermined subject body portion. Due to this, it is easy to install this device even to a predetermined subject body portion of which a joint has suffered contracture, such as a finger or the like. It should be understood that a belt made from fabric, a belt made from metal, a plastic belt, or a wire or the like may be employed as the fastening member.

As has been explained above, according to the joint motion facilitation device of the present invention, the advantageous effects are obtained that, along with easy fitting being possible, it is also possible to facilitate sufficient joint motion for each joint.

DETAILED DESCRIPTION

In the following, an embodiment of the present invention will be explained with reference to FIGS. 1 through 8A and 8B. It should be understood that, in this embodiment, as an example, a joint motion facilitation device that facilitates joint motion of the fingers and wrist of the right hand of the body of a human subject, which is the predetermined subject body portion in this case, will be explained. Moreover, in the following explanation and drawings, the same reference symbols are appended to elements that are the same or equivalent, and duplicated explanation is omitted.

[Structure]

Figure 1:
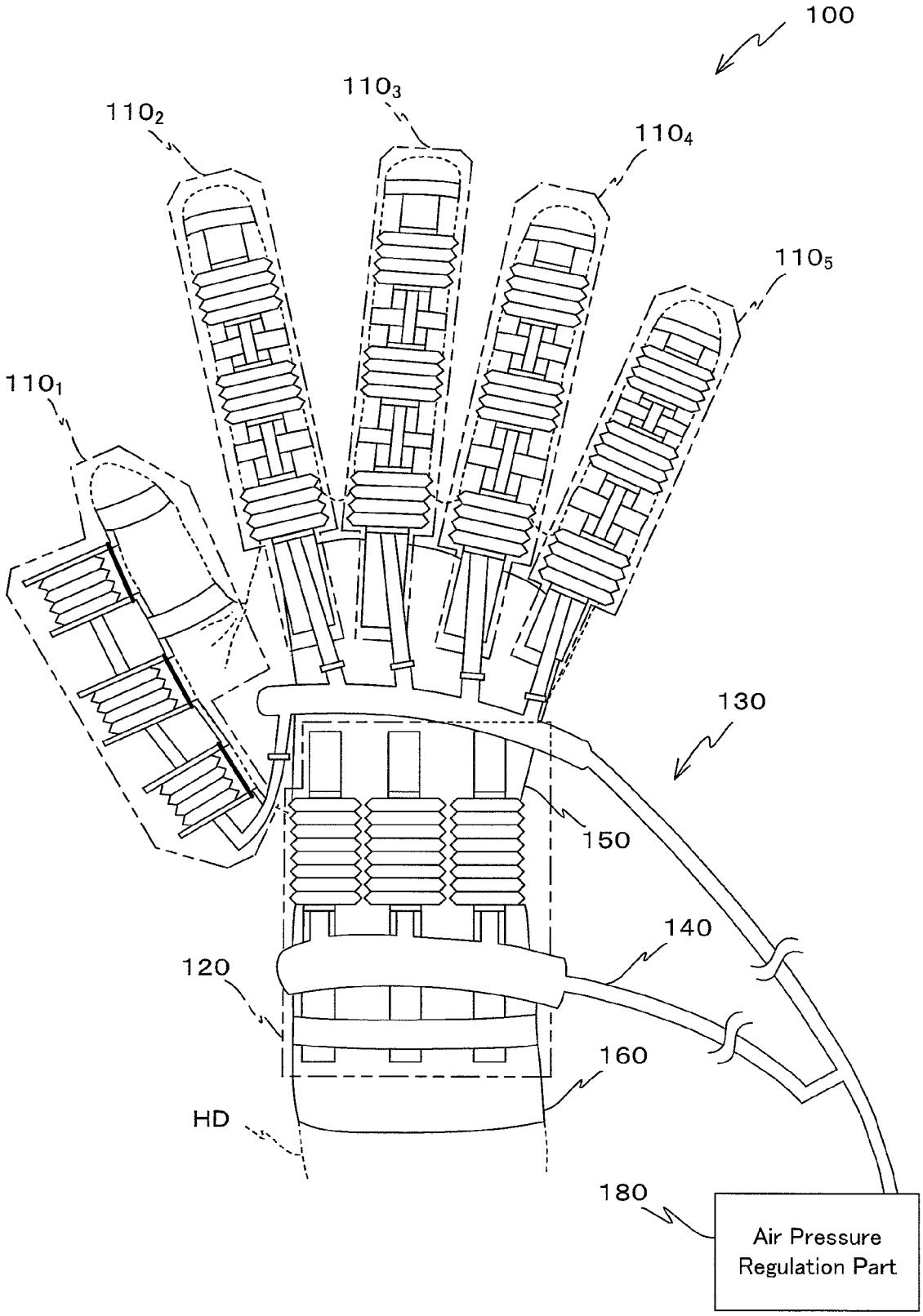
FIG. 1 is a figure showing the external appearance of a joint motion facilitation device that is an embodiment of the present invention.

FIG. 1 is a figure showing the external appearance of a joint motion facilitation device 100 that is an embodiment. FIG. 1 is a figure showing the external appearance of the joint motion facilitation device 100 that is installed to a hand HD of the body of a human subject, as viewed from the hand rear (i.e. the back of the hand) when the joints of the fingers and the wrist are in the extended state.

As shown in FIG. 1, this joint motion facilitation device 100 comprises five finger joint motion facilitation parts (actuators for the fingers) $\mathbf{110}_1$, $\mathbf{110}_2$, $\mathbf{110}_3$, $\mathbf{110}_4$, and $\mathbf{110}_5$, and a wrist joint motion facilitation part 120 (an actuator for the wrist). Furthermore, this joint motion facilitation device 100 comprises a conduit for finger joint motion 130, a conduit for wrist joint motion 140, and mounting sheets 150 and 160. Moreover, this joint motion facilitation device 100 comprises an air pressure regulation part 180, which serves as an air pressure regulation part.

Each of the finger joint motion facilitation parts $\mathbf{110}_1$ through $\mathbf{110}_5$ is installed upon a corresponding finger, and facilitates the motion of the joints of that finger. Here, the finger joint motion facilitation part $\mathbf{110}_1$ is installed upon the thumb. Moreover, the finger joint motion facilitation part $\mathbf{110}_2$ is installed upon the index finger and the finger joint motion facilitation part $\mathbf{110}_3$ is installed upon the middle finger. Furthermore, the finger joint motion facilitation part $110_4$ is installed upon the ring finger and the finger joint motion facilitation part $110_5$ is installed upon the little finger. And each of these finger joint motion facilitation parts $110_1$ through $110_5$ is connected to the conduit for finger joint motion 130.

Figure 2A:
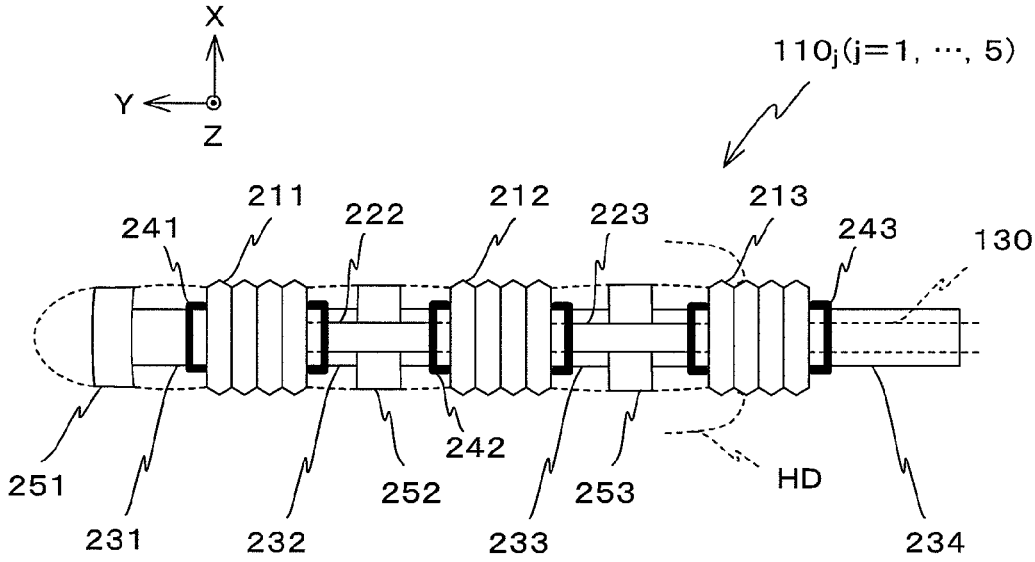
FIG. 2A is a first portion of a figure for explanation of the structure of a finger joint motion facilitation part of FIG. 1.
Figure 2B:
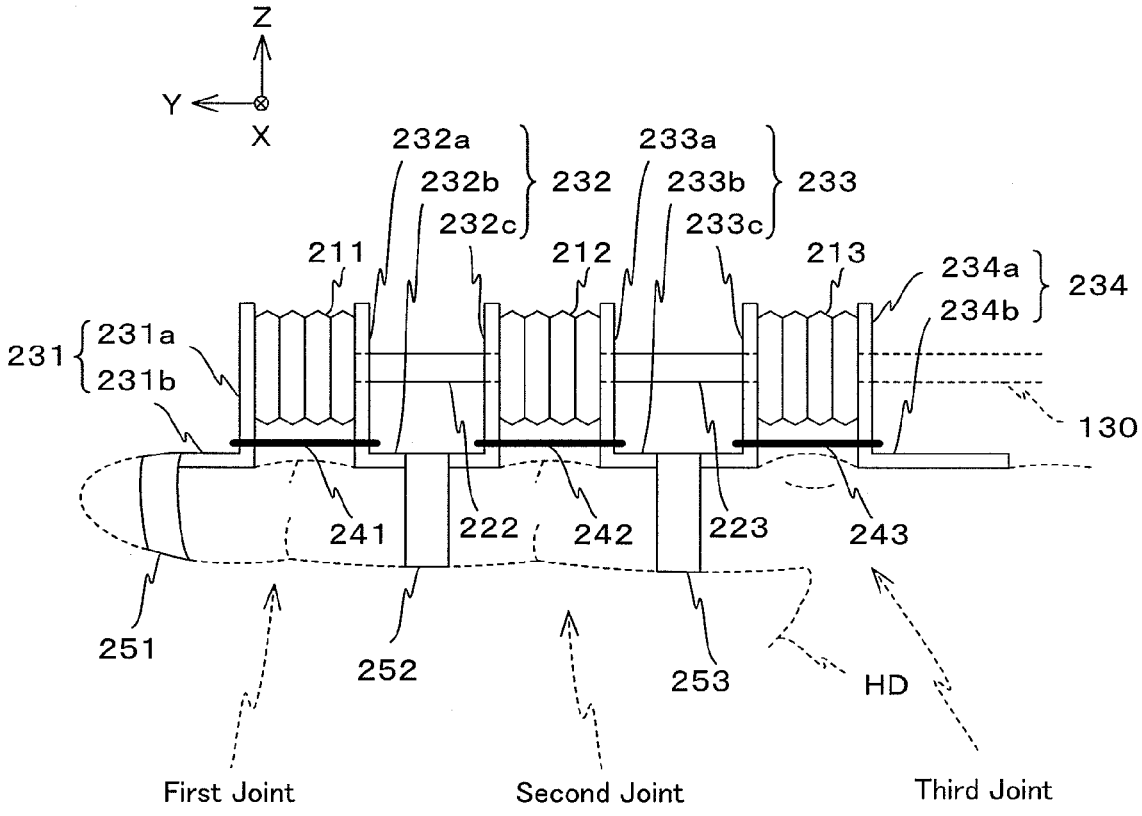
FIG. 2B is a second portion of this figure for explanation of the structure of a finger joint motion facilitation part of FIG. 1.

As generally shown in FIGS. 2A and 2B, each of these finger joint motion facilitation parts $110_1$ (where j=1, . . . 5) comprises bellows 211, 212, and 213, conduits 222 and 223, and transmission members 231, 232, 233, and 234. Furthermore, the finger joint motion facilitation part $110_j$ comprises elastic members 241, 242, and 243 that serves as restraining members, and belt members 251, 252, and 253 that serve as fastening members. Here, the coordinate system (X,Y,Z) used in FIGS. 2A and 2B is the coordinate system in which, with the joints in the extended state, the direction along the finger towards the fingertip is taken as being the +Y direction, and the direction extending from the side towards which the joints flex towards the side towards which they extend is taken as being the +Z direction. It should be understood that, in FIGS. 2A and 2B, the bellows 211 through 213 of the finger joint motion facilitation part $110_j$ are shown as being in their contracted states.

The bellows 211, 212, and 213 described above are members made from resin and have annular grooves at regular intervals so that they can expand and contract freely, and they are disposed at the extension sides of the joints of the finger. Here, the bellows 211 is disposed at the first joint region, the bellows 212 is disposed at the second joint region, and the bellows 213 is disposed at the third joint region. Moreover, the bellows 211 and 212 are communicated with one another by the conduit 222 which is made from resin, and the bellows 212 and 213 are likewise communicated with one another by the conduit 223 which is also made from resin. And, when the air pressure in the bellows 211 through 213 changes via the conduit for finger joint motion 130 which is communicated with the bellows 213, the bellows 211 through 213 expand and contract. As a result, the bellows 211 generates a force that facilitates motion of the first joint, the bellows 212 generates a force that facilitates motion of the second joint, and the bellows 213 generates a force that facilitates motion of the third joint. The mechanisms by which these forces for facilitating joint motion are generated, and the mechanisms for transmitting these forces to the joints, will be described hereinafter.

The transmission members 231, 232, 233, and 234 described above may, for example, be made by bending long flat metallic plates along folding lines that are perpendicular to their longitudinal directions. Here, the transmission members 231 and 234 are formed by the metallic plates being bent into letter-L shapes, while the transmission members 232 and 233 are formed by the metallic plates being bent into letter-U shapes. It should be understood that the folding angles of these transmission members 231 through 234 are set to appropriate angles so that they can be adapted to the range of movement which the joints require in order for their flexion and extension motions to be facilitated. Moreover, it would also be acceptable to arrange to make the transmission members 231 through 234 by forming wires into approximately rectangular rings, and by folding these wires that have been made into rings into letter-L shapes or letter-U shapes.

The transmission member 231 has flat plate portions 231*a* and 231*b*. And the flat plate portion 231*a* is adhered to the side of the bellows 211 towards the +Y direction in its expansion and contraction direction, while the flat plate portion 231*b* is mounted upon the distal phalange between the fingertip and the first joint, and is fastened upon the distal phalange by the belt member 251 that is made from fabric and is wrapped around the flat plate portion 231*b*.

The transmission member 232 has flat plate portions 232*a*, 232*b*, and 232*c*, and holes (not shown in the figures) for passing the conduit 222 are provided at the approximate centers of the flat plate portion 232*a* and the flat plate portion 232*c*. And the flat plate portion 232*a* is adhered to the side of the bellows 211 towards the −Y direction in its expansion and contraction direction, while the flat plate portion 232*c* is adhered to the side of the bellows 212 towards the +Y direction. Moreover, the flat plate portion 232*b* is mounted upon the medial phalange between the first joint and the second joint, and is fastened upon the medial phalange by the belt member 252 that is made from fabric and is wrapped around the flat plate portion 232*b*.

The transmission member 233 has flat plate portions 233*a*, 233*b*, and 233*c*, and holes (not shown in the figures) for passing the conduit 223 are provided at the approximate centers of the flat plate portion 233*a* and the flat plate portion 233*c*. And the flat plate portion 233*a* is adhered to the side of the bellows 212 towards the −Y direction in its expansion and contraction direction, while the flat plate portion 233*c* is adhered to the side of the bellows 213 towards the +Y direction. Moreover, the flat plate portion 233*b* is mounted upon the proximal phalange between the second joint and the third joint, and is fastened upon the proximal phalange by the belt member 253 that is made from fabric and is wrapped around the flat plate portion 233*b*. It should be understood that, in the finger joint motion facilitation part $110_1$ that is installed upon the thumb, it is arranged for the flat plate portion 233*b* to be fastened by a metallic belt not shown in the figures.

The transmission member 234 has flat plate portions 234*a* and 234*b*, and a hole (not shown in the figures) for passing the conduit for finger joint motion 130 is provided at the approximate center of the flat plate portion 234*a*. And the flat plate portion 234*a* is adhered to the side of the bellows 213 towards the −Y direction, while the flat plate portion 234*b* is mounted upon the back of the hand between the third joint and the wrist joint towards the finger side thereof, and is fastened there. It should be understood that, in this embodiment, it is arranged for the flat plate portion 234*b* to be fastened upon the back of the hand at a location near the finger via the mounting sheet 150 (not shown in FIGS. 2A and 2B; refer to FIG. 1), to which the flat plate portion 234*b* is adhered.

In this embodiment, ring shaped rubber members are employed as the elastic members 241 through 243 described above. Here, the elastic member 241 is fitted over the flat plate portion of the transmission member 231 and the flat plate portion of the transmission member 232 in the +Y direction, and elastically restrains the annular grooves of the bellows 211 on the side thereof that opposes the first joint. Moreover, the elastic member 242 is fitted over the flat plate portion of the transmission member 232 in the −Y direction and the flat plate portion of the transmission member 233 in the +Y direction, and elastically restrains the annular grooves of the bellows 212 on the side thereof that opposes the second joint. Furthermore, the elastic member 243 is fitted over the flat plate portion of the transmission member 233 in the −Y direction and the flat plate portion of the transmission member 234, and elastically restrains the annular grooves of the bellows 213 on the side thereof that opposes the third joint. It should be understood that the hardnesses of these elastic members 241 through 243 are determined in advance of the basis of experiment, simulation, experience and so on, from the standpoint of effectively performing rehabilitation related to contracture of the fingers.

Figure 3A:
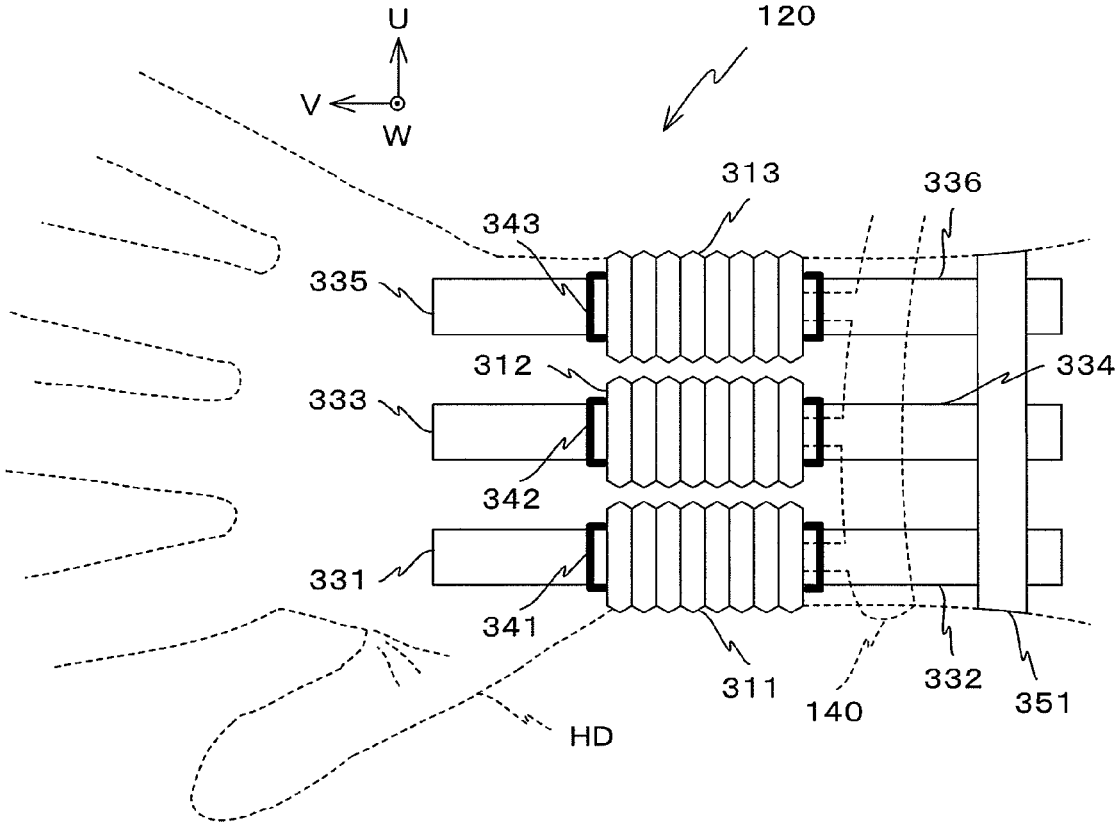
FIG. 3A is a first portion of a figure for explanation of the structure of a wrist joint motion facilitation part of FIG. 1.
Figure 3B:
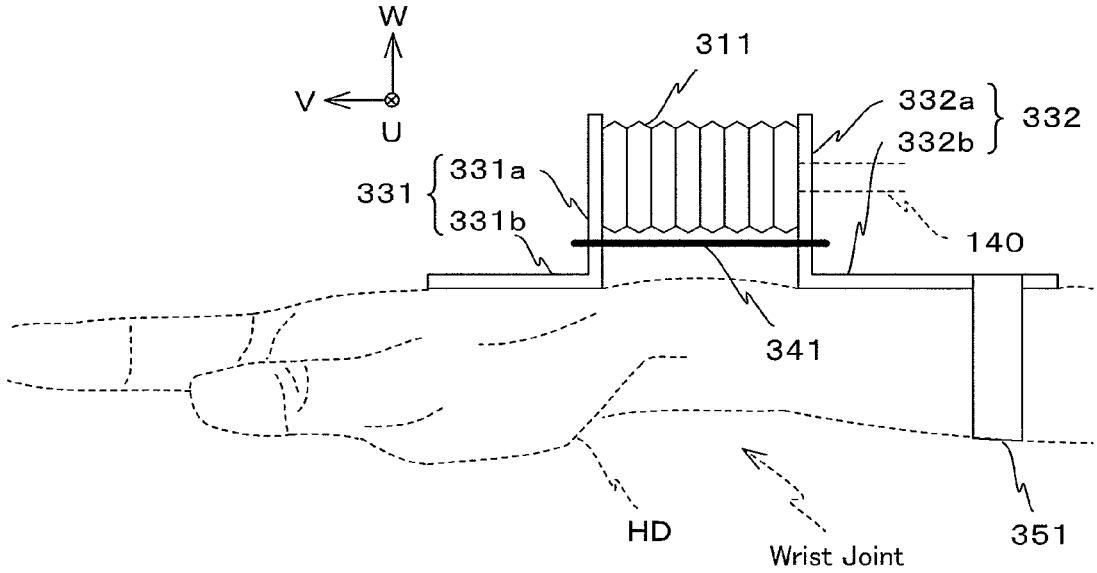
FIG. 3B is a second portion of this figure for explanation of the structure of a wrist joint motion facilitation part of FIG. 1.

Returning to FIG. 1, the wrist joint motion facilitation part 120 mentioned above is installed upon the wrist, and facilitates joint motion of the wrist. As generally shown in FIGS. 3A and 3B, this wrist joint motion facilitation part 120 comprises bellows 311, 312, and 313, and transmission members 331, 332, 333, 334, 335, and 336. Furthermore, the wrist joint motion facilitation part 120 comprises elastic members 341, 342, and 343 that function as restraining members, and a belt member 351 that functions as a fastening member. Here, the coordinate system (U,V,W) in FIGS. 3A and 3B is the coordinate system in which, with the wrist joint in the extended state, the direction from the wrist towards the middle finger is taken as being the +V direction, and the direction extending from the side towards which the wrist joint flexes towards the side towards which it extends is taken as being the +W direction. It should be understood that, in FIGS. 3A and 3B, the bellows 311 through 313 of this wrist joint motion facilitation part 120 are shown in their states when they are contracted.

The bellows 311, 312, and 313 described above are members made from resin having annular grooves at regular intervals that enable them to expand and contract freely, and they are arranged along the extension side of the wrist joint. Here, the bellows 311, 312, and 313 are arranged in parallel along the U direction. And when the air pressure in the bellows 311 through 313 changes via the conduit for wrist joint motion 140 that is communicated with these bellows, each of the bellows expands or contracts. As a result, the bellows 311 through 313 generate forces for facilitating motion of the wrist joint.

The transmission members 331 through 336 mentioned above are made by folding long flat metallic plates along folding lines perpendicular to their longitudinal directions into letter-L shapes, in the same way as the transmission members 231 through 234 described above. It should be understood that the folding angles of these transmission members 331 through 336 are set to appropriate angles so that they can be adapted to the range of movement which the wrist joint requires in order for its flexion and extension motions to be facilitated. Moreover, it would also be acceptable to arrange to make the transmission members 331 through 336 by forming wires into approximately rectangular rings, and by folding these wires that have been made into rings into letter-L shapes.

The transmission member 331 has flat plate portions 331*a* and 331*b*. And the flat plate portion 331*a* is adhered to the side of the bellows 311 towards the +V direction in its expansion and contraction direction, while the flat plate portion 331*b* is mounted upon the back of the hand near the wrist, and is fastened there. Moreover, the transmission member 332 has flat plate portions 332*a* and 332*b*, and a hole (not shown in the figures) for passing the conduit for wrist joint motion 140 is provided at the approximate center of the flat plate portion 332*a*. And the flat plate portion 332*a* is adhered to the side of the bellows 311 towards the −V direction, while the flat plate portion 332*b* is mounted upon the forearm at the portion thereof near the wrist, and is fastened upon the forearm by the belt member 351 which is made from fabric.

The transmission member 333 is made in a similar manner to the transmission member 331, and has two flat plate portions. And one of these flat plate portions is adhered to the side of the bellows 312 towards the +V direction in its expansion and contraction direction, while the other flat plate portion is mounted upon the back of the hand near the wrist, and is fastened there. Moreover, the transmission member 334 is made in a similar manner to the transmission member 332, and has two flat plate portions. And one of these flat plate portions is adhered to the side of the bellows 312 towards the −V direction, while the other flat plate portion is mounted upon the forearm at the portion thereof near the wrist, and is fastened upon the forearm by the belt member 351.

The transmission member 335 is made in a similar manner to the transmission member 331, and has two flat plate portions. And one of these flat plate portions is adhered to the side of the bellows 313 towards the +V direction in its expansion and contraction direction, while the other flat plate portion is mounted upon the back of the hand near the wrist, and is fastened there. Moreover, the transmission member 336 is made in a similar manner to the transmission member 332, and has two flat plate portions. And one of these flat plate portions is adhered to the side of the bellows 313 towards the −V direction, while the other flat plate portion is mounted upon the forearm at the portion thereof near the wrist, and is fastened upon the forearm by the belt member 351.

It should be understood that, in this embodiment, it is arranged for the fixing of the flat plate portions of the transmission members 331, 333, and 335 upon the back of the hand on the side thereof toward the wrist to be performed via the mounting sheet 150 (not shown in FIGS. 3A and 3B; refer to FIG. 1), to which these flat plate portions are adhered. Moreover, it is arranged for the fixing of the flat plate portions of the transmission members 332, 334, and 336 upon the forearm at the portion thereof near the wrist to be performed via the mounting sheet 160 (not shown in FIGS. 3A and 3B; refer to FIG. 1) to which these flat plate portions are adhered, and via the belt member 351.

In this embodiment, ring shaped rubber members are employed as the elastic members 341 through 343 described above, in a way like that for the elastic members 241 through 243 described above. Here, the elastic member 341 is fitted over the flat plate portion of the transmission member 331 and the flat plate portion of the transmission member 332, and elastically restrains the annular grooves of the bellows 311 on the side thereof that opposes the wrist joint. Moreover, the elastic member 342 is fitted over the flat plate portion of the transmission member 333 and the flat plate portion of the transmission member 334, and elastically restrains the annular grooves of the bellows 312 on the side thereof that opposes the wrist joint. Furthermore, the elastic member 343 is fitted over the flat plate portion of the transmission member 335 and the flat plate portion of the transmission member 336, and elastically restrains the annular grooves of the bellows 313 on the side thereof that opposes the wrist joint. It should be understood that the hardnesses of these elastic members 341 through 343 are determined in advance of the basis of experiment, simulation, experience and so on, from the standpoint of effectively performing rehabilitation related to contracture of the wrist.

Figure 4:
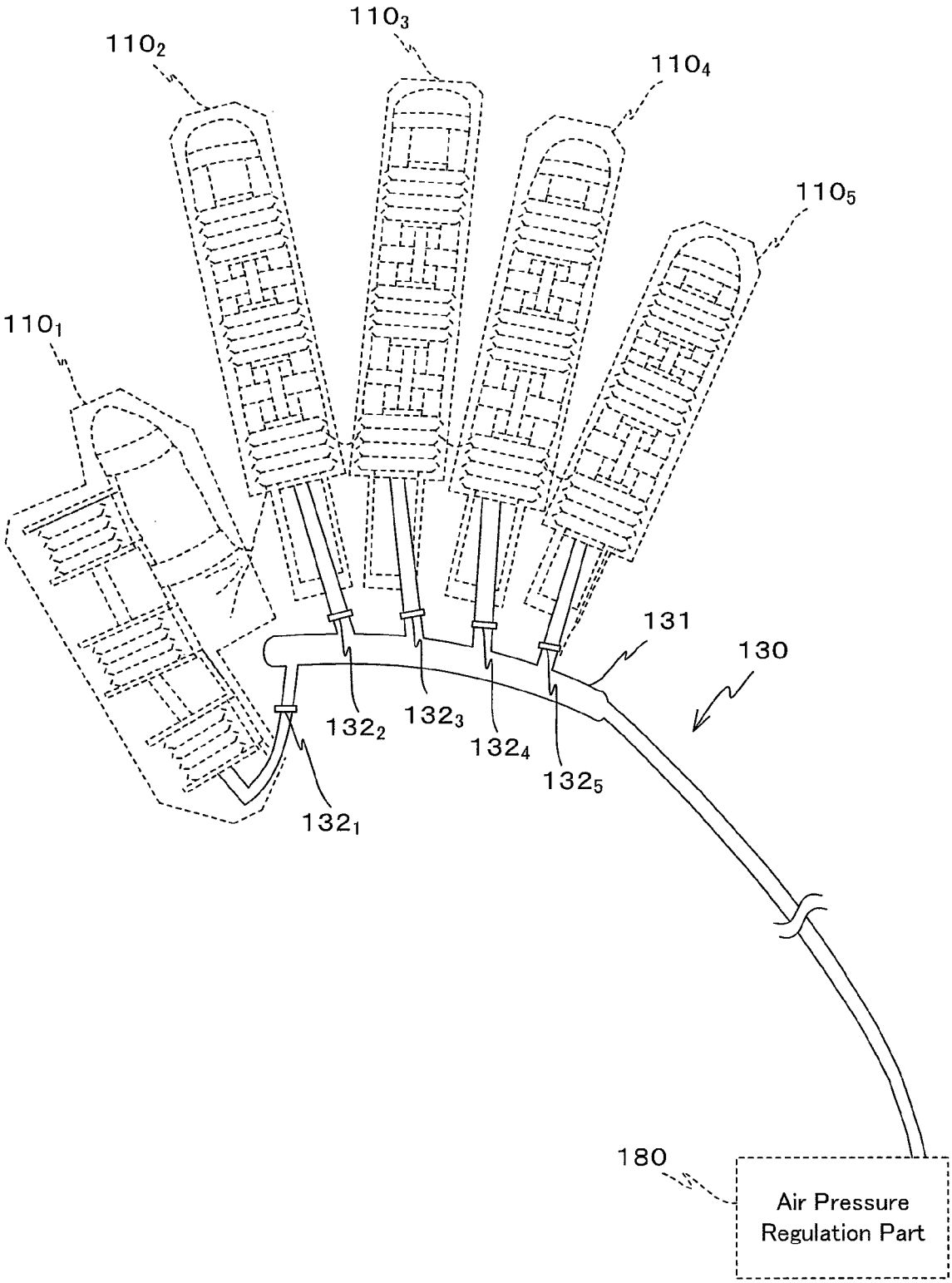
FIG. 4 is a figure for explanation of the structure of a conduit for providing finger joint motion of FIG. 1.

As shown in FIG. 4, the above described conduit for finger joint motion 130 comprises a tube 131, and five opening and closing valves $\mathbf{132}_j$ (where j=1, . . . , 5) that serve as selection parts. A tube 131 is made from a flexible resin, and one end thereof is connected to the bellows 213 of each of the five finger joint motion facilitation parts $\mathbf{110}_j$ (where j=1, . . . , 5), while its other end is connected to the air pressure regulation part 180.

The opening and closing valve $\mathbf{132}_1$ is provided upon the tube that connects to the finger joint motion facilitation part $\mathbf{110}_1$. Moreover, the opening and closing valve $\mathbf{132}_2$ is provided upon the tube that connects to the finger joint motion facilitation part $\mathbf{110}_2$, and the opening and closing valve $\mathbf{132}_3$ is provided upon the tube that connects to the finger joint motion facilitation part $\mathbf{110}_3$. Furthermore, the opening and closing valve $\mathbf{132}_4$ is provided upon the tube that connects to the finger joint motion facilitation part $\mathbf{110}_4$, and the opening and closing valve $132_5$ is provided upon the tube that connects to the finger joint motion facilitation part $110_5$. By actuating the opening and closing valves $132_j$ that are arranged in this manner, it becomes possible to perform opening and closing of the tubes through which air passes.

Returning to FIG. 1, the conduit for wrist joint motion 140 described above is a tube made from a flexible resin. One end of this conduit for wrist joint motion 140 is connected to the bellows 311 through 313 of the wrist joint motion facilitation part 120, while its other end is connected to the air pressure regulation part 180. In this embodiment, the flat plate portions 234 of the finger joint motion facilitation parts $110_j$ (where j=1, . . . , 5) and the plate portions of the transmission members 331, 333, and 335 of the wrist joint motion facilitation part 120 are adhered to the mounting sheet 150 described above, and are thereby mounted upon the back of the hand. Due to this, along with the flat plate portions 234*b* of the finger joint motion facilitation parts $110_j$ being fixed upon the back of the hand on its side towards the fingers, the flat plate portions of the transmission members 331, 333, and 335 are fixed upon the back of the hand on its side towards the wrist. It should be understood that it is arranged for this mounting sheet 150 to be mounted upon the back of the hand by a metallic belt not shown in the fingers, surrounding and gripping the little finger.

In, this embodiment, the plate portions of the transmission members 332, 334, and 336 of the wrist joint motion facilitation part 120 are adhered to the mounting sheet 160 described above, and are thereby mounted upon the forearm at a portion thereof near to the wrist. By doing this, the flat plate portions of the transmission members 332, 334, and 336 are fixed upon the forearm near to the wrist.

Figure 5:
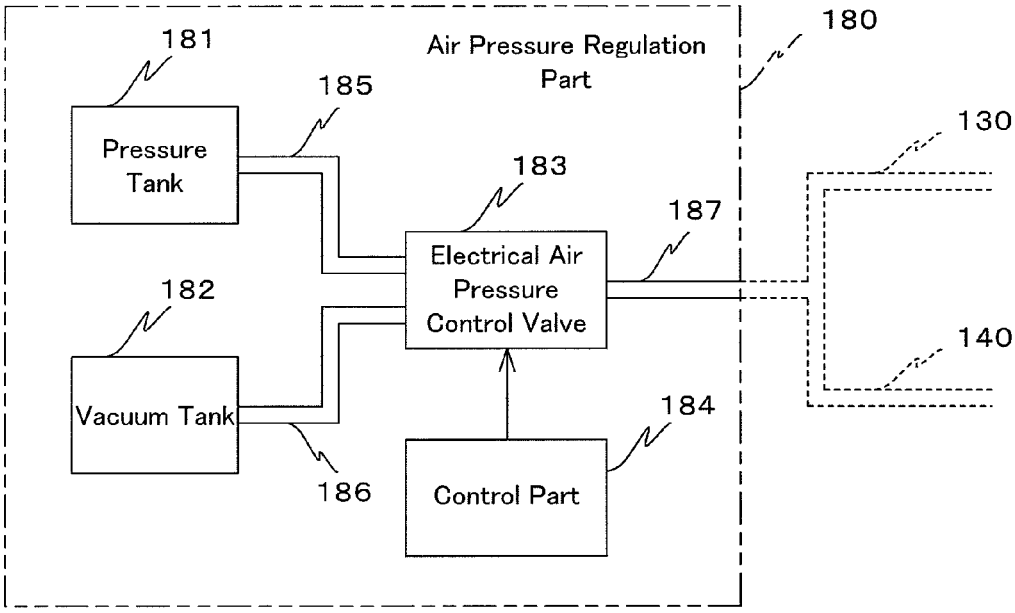
FIG. 5 is a figure for explanation of the structure of an air pressure regulation part of FIG. 1.

The air pressure regulation part 180 described above is communicated to the bellows 213 of each of the finger joint motion facilitation parts $110_j$ (where j=1, . . . , 5) via the conduit for finger joint motion 130, and is also communicated to the bellows 311 through 313 of the wrist joint motion facilitation part 120 via the conduit for wrist joint motion 140. And the air pressure regulation part 180 regulates the air pressure in the bellows by performing supply of air to the bellows 211 through 213 of the finger joint motion facilitation parts $110_j$ and to the bellows 311 through 313 of the wrist joint motion facilitation part 120 (in the following, "bellows" will be used as a generic term for all of the bellows) and by performing exhausting of air from these bellows, via the conduit for finger joint motion 130 and the conduit for wrist joint motion 140. As shown in FIG. 5, this air pressure regulation part 180 that has this function comprises a pressure tank 181, a vacuum tank 182, and an electrical air pressure control valve 183. Moreover, the air pressure regulation part 180 comprises a control part 184 and conduits 185, 186, and 187.

The pressure tank 181 described above is connected to one inlet side of the electrical air pressure control valve 183 via the conduit 185. This pressure tank 181 is used when performing supply of air to the bellows. And the vacuum tank 182 described above is connected to the other inlet side of the electrical air pressure control valve 183 via the conduit 186. This vacuum tank 182 is used when performing exhausting of air from the bellows.

The electrical air pressure control valve 183 described above comprises a three-way flow conduit changeover valve and a pressure control valve (of the proportional solenoid type). Along with one inlet of this three-way flow conduit changeover valve being connected to the pressure tank 181, its other inlet is connected to the vacuum tank 182. And when, based upon control by the control part 184, supply of air is to be performed to the bellows, this three-way flow conduit changeover valve is changed over to the flow conduit that is connected to the pressure tank 181; while, when air is to be exhausted from the bellows, it is changed over to the flow conduit that is connected to the vacuum tank 182. Moreover, based upon control by the control part 184, the pressure control valve controls the output pressure level, and thus changes the air pressure in the bellows via the conduit 187.

Figure 6:
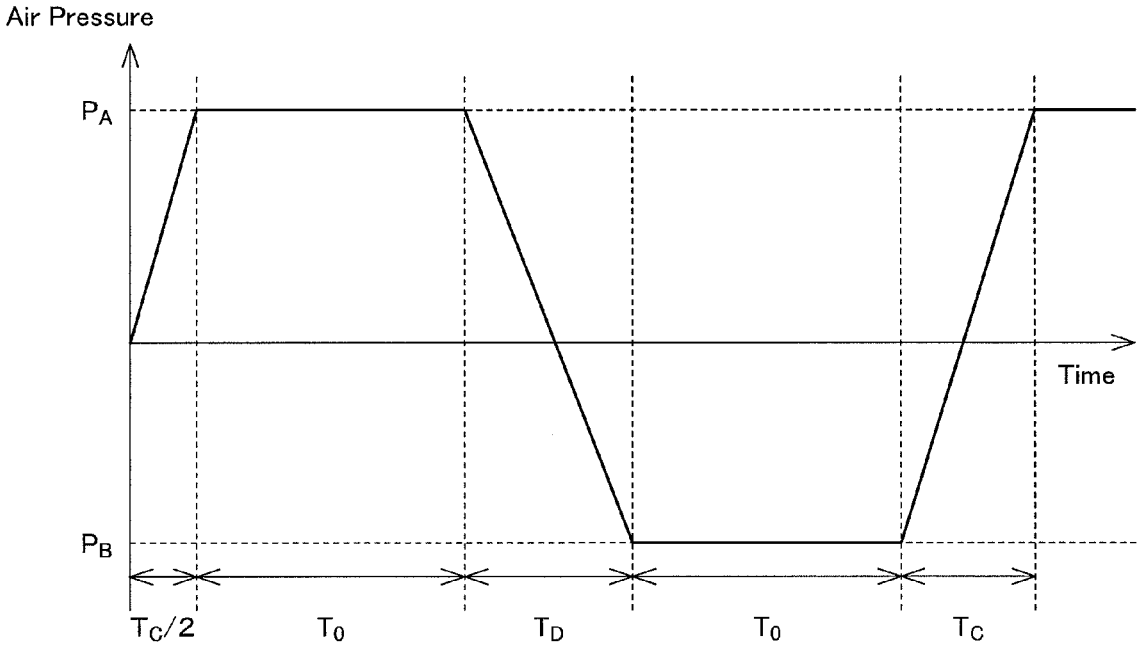
FIG. 6 is a figure for explanation of the way in which air pressure in bellows is controlled.

The control part 184 described above performs changeover control so as either to supply air to the bellows or to exhaust air from the bellows. During this control, upon receipt of a start command from the user, the control part 184 sends a changeover command to the electrical air pressure control valve 183, a command to the effect that the flow conduit that is connected to the pressure tank 181 to be changed over. A pressure regulation command is included in this changeover command, and, as shown in FIG. 6, supply of air to the bellows is performed for a time period $T_C/2$, so that the air pressure in the bellows is raised to a pressure $P_A$ (in the following, the time period $T_C$ will also sometimes be termed the "pressure increase time period $T_C$"). Subsequently, the control part 184 maintains the air pressure in the bellows at the pressure $P_A$ over a predetermined time period $T_0$. And, when this predetermined time period $T_0$ has elapsed, the control part 184 sends a changeover command to the electrical air pressure control valve 183, a command to the effect that the flow conduit that is connected to the vacuum tank 182 to be changed over. A pressure regulation command is included in this changeover command, and the vacuum tank 182 performs exhausting of air from the bellows over a time period $T_D$, so that the air pressure in the bellows is reduced to a pressure $P_B$ (in the following, the time period $T_D$ will also sometimes be termed the "pressure reduction time period $T_D$").

Next, the control part 184 maintains the air pressure in the bellows at the pressure $P_B$ over the predetermined time period $T_0$. And, when this predetermined time period $T_0$ has elapsed, the control part 184 sends a changeover command to the electrical air pressure control valve 183, a command to the effect that the flow conduit that is connected to the pressure tank 181 to be changed over. As described above, a pressure regulation command is included in this changeover command, and the pressure tank 181 performs supply of air to the bellows over the pressure increase time period $T_C$, so that the air pressure in the bellows is increased to the pressure $P_A$. Subsequently, the control part 184 performs the changeover control described above for air supply and exhaust repeatedly. All of the pressures $P_A$ and $P_B$, and the pressure increase time period $T_C$ and the pressure reduction time period $T_D$ described above, are determined in advance on the basis of bio-monitoring information related to the muscles that actuate the joints, experiment, simulation, experience and so on, from the viewpoint of effectively performing rehabilitation related to contracture of the fingers and the wrist.

Here, it may be arranged for this bio-monitoring information related to the muscles that actuate the joints to be acquired by a detection part not shown in the figures such as one that detects an electromyelogram, the hardness of the muscles, or the like.

Furthermore, the predetermined time period $T_0$ is also determined in advance on the basis of experiment, simulation, experience or the like, from the viewpoint of effectively performing rehabilitation related to contracture of the fingers and the wrist.

[Operation]

The operation of the joint motion facilitation device 100 having the structure described above will now be explained, with attention being principally directed to operation to facilitate the motion of the finger joints and the wrist joint. It should be understood that it will be supposed that this joint motion facilitation device 100 is mounted upon a hand HD of the body of a human subject, and that, initially, no pressure regulation of the air pressure in the bellows is being performed by the air pressure regulation part 180. Moreover, it will be supposed that the opening and closing valves $\mathbf{132}_j$ provided upon the tubes connected to the finger joint motion facilitation parts $\mathbf{110}_j$ (where j=1, . . . ,5) are open.

This joint motion facilitation processing starts upon the user sending a start command to the control part of the air pressure regulation part 180. Upon receipt of this start command, the air pressure regulation part 180 performs changing over between supply of air to the bellows and exhausting of air from the bellows, via the conduit for finger joint motion 130 and the conduit for wrist joint motion 140.

When supply of air is performed by the air pressure regulation part 180 via the conduit for finger joint motion 130 to the bellows 211 through 213 of the finger joint motion facilitation parts $\mathbf{110}_j$ (where j=1, . . . , 5), the air pressure inside these bellows 211 through 213 is elevated. And, when this air pressure inside the bellows 211 through 213 rises so that the internal bellows pressure has attained a proper pressure level, the state of the finger joint motion facilitation parts $\mathbf{110}_j$ is as shown in FIG. 7A.

Figure 7A:
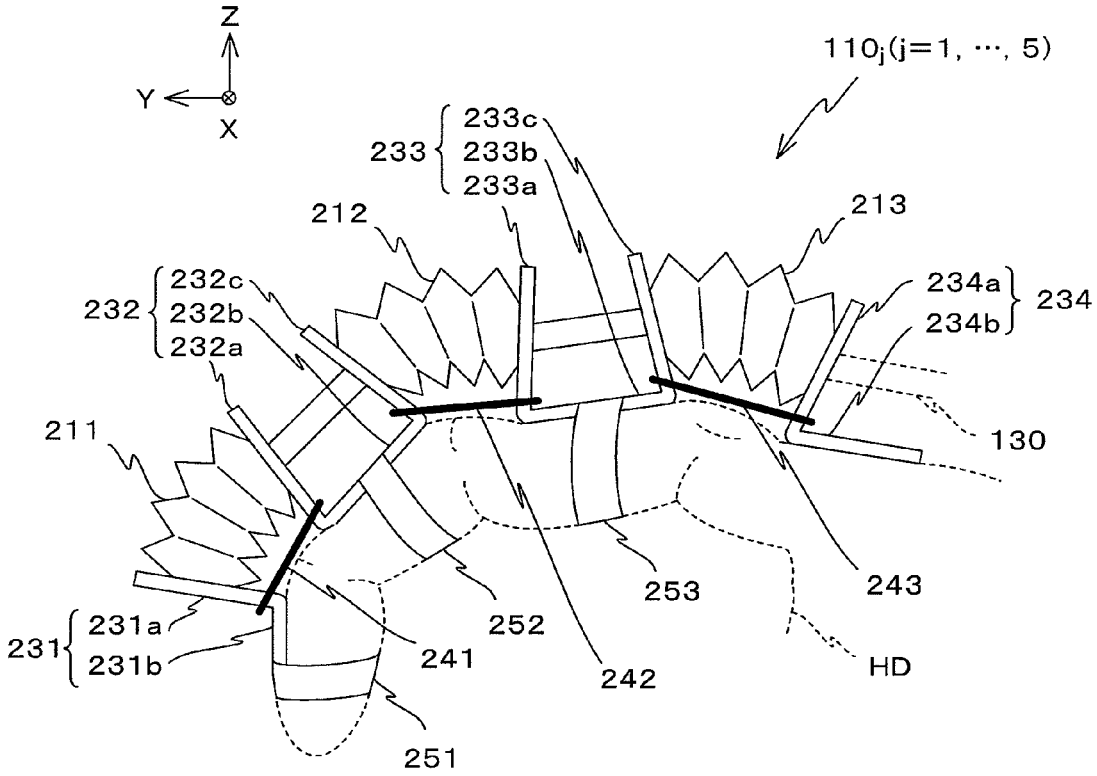
FIG. 7A is a figure for explanation of the state of a finger joint motion facilitation part when the air pressure in its bellows has been elevated.

As shown in FIG. 7A, due to this rise of the air pressure, the widths of the gaps between the annular grooves of the bellows 211 through 213 widen, but, since the annular grooves at the sides of the bellows 211 through 213 that face the joints are elastically restrained by the elastic members 241 through 243, accordingly the bellows 211 through 213 expand to have approximately circular arc shapes, as seen in the Y-Z plane. As a result, in cooperation, the bellows 211 through 213 generate forces in the rotational directions to make the first through the third joints of the fingers flex from their extended states. Moreover, by the elastic members 241 through 243 elastically restraining the annular grooves on the sides of the bellows 211 through 213 that face the joints, expansion and contraction of the distance between the joints along with this flexion and extension motion is absorbed.

In this manner, forces generated by the bellows 211 in the rotational directions to make the first joints flex from their extended states are transmitted to the first joints by the flat plate portions 231*b* and the flat plate portions 232*b*. Moreover, forces generated by the bellows 212 in the rotational directions to make the second joints flex from their extended states are transmitted to the second joints by the flat plate portions 232*b* and the flat plate portions 233*b*. Furthermore, forces generated by the bellows 213 in the rotational directions to make the third joints flex from their extended states are transmitted to the third joints by the flat plate portions 233*b* and the flat plate portions 234*b*. As a result, the first through the third joints of the fingers are brought into their flexed states.

Furthermore, when supply of air is performed by the air pressure regulation part 180 via the conduit for wrist joint motion 140 to the bellows 311 through 313 of the wrist joint motion facilitation part 120, the air pressure in the bellows 311 through 313 is elevated. And, when this air pressure inside the bellows 311 through 313 rises so that the internal bellows pressure has attained a proper and sufficient pressure level, the state of the wrist joint motion facilitation part 120 is as shown in FIG. 8A.

Figure 8A:
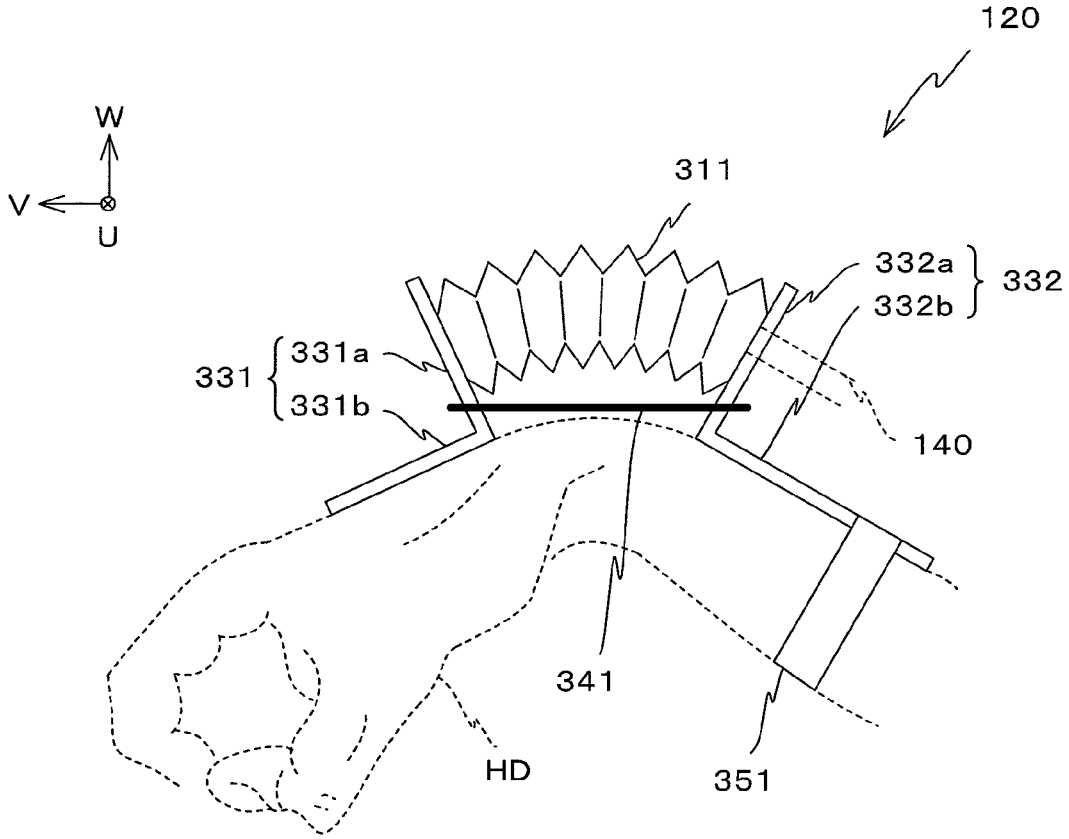
FIG. 8A is a figure for explanation of the state of a wrist joint motion facilitation part when the air pressure in its bellows has been elevated.

As shown in FIG. 8A, due to this rise of the air pressure, the widths of the gaps between the annular grooves of the bellows 311 through 313 (the bellows 312 and 313 are not shown in FIG. 8; refer to FIG. 3) widen, but, since the annular grooves at the sides of the bellows 311 through 313 that face the joint are elastically restrained by the elastic members 341 through 343 (the elastic members 342 and 343 are not shown in FIG. 8; refer to FIG. 3), accordingly the bellows 311 through 313 expand to have approximately circular arcuate shapes, as seen in the V-W plane. As a result, the bellows 311 through 313 generate forces in the rotational direction to make the wrist joint flex from its extended state. Moreover, by the elastic members 341 through 343 elastically restraining the annular grooves on the sides of the bellows 311 through 313 that face the joint, expansion and contraction of the distance across the joint along with this flexion and extension motion is absorbed. In this manner, forces generated by the bellows 311 through 313 in the rotational direction to make the wrist joint flex from its extended state are transmitted to the wrist joint by the flat plate portions 331*b* and so on that are fixed upon the back of the hand and the flat plate portions 332*b* and so on that are fixed to the portion of the forearm near the wrist. As a result, the wrist joint is brought into its flexed state.

Thereafter, the air pressure regulation part 180 maintains the air pressure in the bellows at the pressure $P_A$ over the predetermined time period $T_0$. And, when this predetermined time period $T_0$ has elapsed, the air pressure regulation part 180 performs exhausting of air from the bellows (refer to FIG. 6). When exhausting of air from the bellows 211 through 213 of the finger joint motion facilitation parts $\mathbf{110}_j$ (where j=1, . . . , 5) is performed by the air pressure regulation part 180 via the conduit for finger joint motion 130 in this manner, the air pressure within the bellows 211 through 213 decreases. And, when this air pressure inside the bellows 211 through 213 drops so that the internal bellows pressure has attained a proper negative pressure level, the state of the finger joint motion facilitation parts $\mathbf{110}_j$ is as shown in FIG. 7B (which is a repetition of FIG. 2B).

Figure 7B:
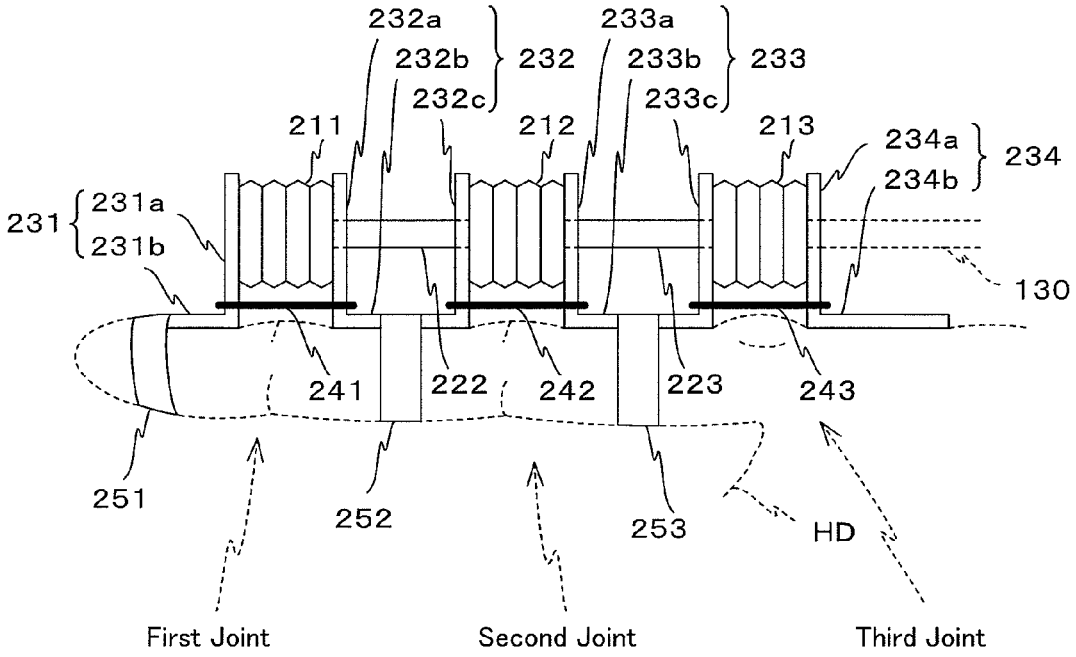
FIG. 7B is a figure for explanation of the state of this finger joint motion facilitation part when the air pressure in its bellows has been lowered.

As shown in FIG. 7B, the bellows 211 through 213 are contracted by lowering of the above air pressure. As a result, in cooperation, the bellows 211 through 213 generate forces in the rotational directions to make the first through the third joints of the fingers extend from their flexed states. Moreover, by the elastic members 241 through 243 elastically restraining the annular grooves on the sides of the bellows 211 through 213 that face the joints as described above, expansion and contraction of the distances between the joints along with this flexion and extension motion is absorbed.

In this manner, forces generated by the bellows 211 in the rotational directions to make the first joints extend from their flexed states are transmitted to the first joints by the flat plate portions 231*b* and the flat plate portions 232*b*. Moreover, forces generated by the bellows 212 in the rotational directions to make the second joints extend from their flexed states are transmitted to the second joints by the flat plate portions 232*b* and the flat plate portions 233*b*. Furthermore, forces generated by the bellows 213 in the rotational directions to make the third joints extend from their flexed states are transmitted to the third joints by the flat plate portions 233*b* and the flat plate portions 234*b*. As a result, the first through the third joints of the fingers are brought from the flexed states into their extended states.

Furthermore, when exhaustion of air is performed by the air pressure regulation part 180 via the conduit for wrist joint motion 140 from the bellows 311 through 313 of the wrist joint motion facilitation part 120, the air pressure in the bellows 311 through 313 is lowered. And, when this air pressure inside the bellows 311 through 313 drops so that the internal bellows pressure has attained a proper and sufficient negative pressure level, the state of the wrist joint motion facilitation part 120 is as shown in FIG. 8B (which is a repetition of FIG. 3B).

Figure 8B:
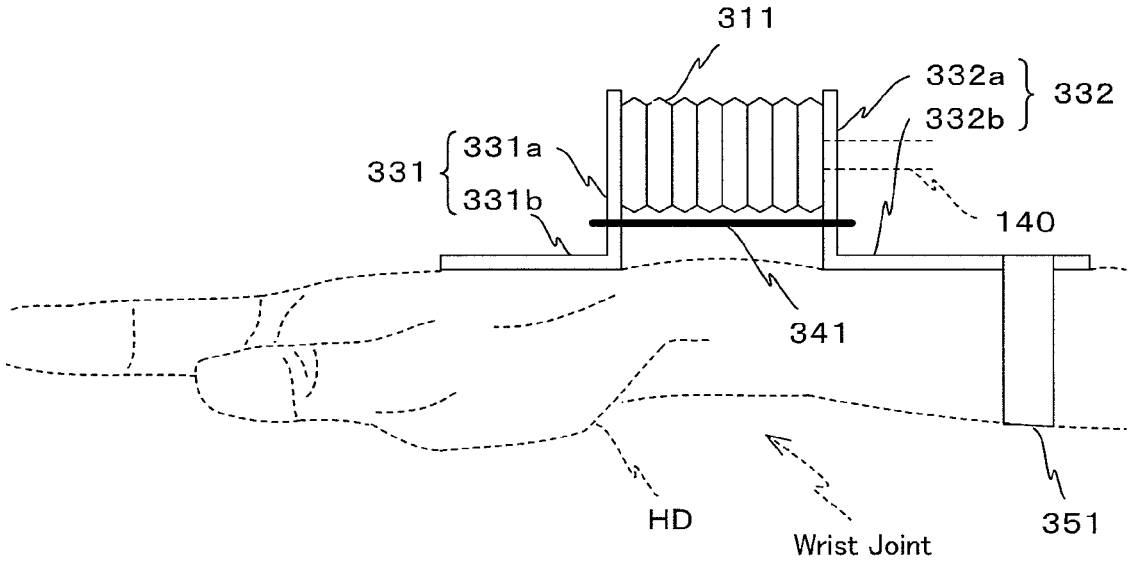
FIG. 8B is a figure for explanation of the state of this wrist joint motion facilitation part when the air pressure in its bellows has been lowered.

As shown in FIG. 8B, due to this dropping of the air pressure, the bellows 311 through 313 contract. As a result, the bellows 311 through 313 generate forces in the rotational direction to make the wrist joint extend from its flexed state. Moreover, by the elastic members 341 through 343 elastically restraining the annular grooves on the sides of the bellows 311 through 313 that face the joints as described above, expansion and contraction of the distances across the joints along with this flexion and extension motion is absorbed. In this manner, forces generated by the bellows 311 through 313 in the rotational direction to make the wrist joint extend from its flexed state is transmitted to the wrist joint by the flat plate portions 331*b* and so on that are fixed upon the back of the hand and the flat plate portions 332*b* and so on that are fixed to the portion of the forearm near the wrist. As a result, the wrist joint is brought from the flexed state into the extended state.

Thereafter, the air pressure regulation part 180 maintains the air pressure in the bellows at the pressure $P_B$ over the predetermined time period $T_0$. And, when this predetermined time period $T_0$ has elapsed, next the air pressure regulation part 180 performs supply of air to the bellows (refer to FIG. 6). As a result, the air pressure in the bellows rises, and the joints of the fingers and the wrist are brought from their extended states to their flexed states (refer to FIGS. 7A and 8A). Subsequently, the air pressure regulation part 180 performs successive changing over between exhausting of air from the bellows and supply of air to the bellows. As a result, flexion and extension motion of the fingers and the wrist is passively performed.

As has been explained above, in this embodiment, the finger joint motion facilitation parts $\mathbf{110}_1$ through $\mathbf{110}_5$ are installed upon the fingers using belt members. And, when supply of air to the bellows 211 through 213 of the finger joint motion facilitation parts $\mathbf{110}_j$ (where j=1, . . . , 5) is performed by the air pressure regulation part 180 via the conduit for finger joint motion 130, since the annular grooves on the sides of the bellows 211 through 213 that oppose the joints are elastically restrained by the elastic members 241 through 243, accordingly the bellows 211 through 213 expand into approximately circular arcuate shapes. Due to this, in cooperation, the bellows 211 through 213 generate forces in the rotational directions to flex the first through the third joints of the fingers from their extended states. The forces generated in this manner by the bellows 211 in the rotational directions to flex the first joints from their extended states are transmitted to the first joints by the flat plate portions 231*b* and the flat plate portions 232*b*. Moreover, the forces generated by the bellows 212 in the rotational directions to flex the second joints from their extended states are transmitted to the second joints by the flat plate portions 232*b* and the flat plate portions 233*b*. Furthermore, the forces generated by the bellows 213 in the rotational directions to flex the third joints from their extended states are transmitted to the third joints by the flat plate portions 233*b* and the flat plate portions 234*b*. As a result, the first through the third joints of the fingers are brought into their flexed states.

Next, the air pressure regulation part 180 performs exhausting of air from the bellows 211 through 213. When exhausting of air from the bellows is performed by the air pressure regulation part 180, the bellows 211 through 213 contract. Due to this, in cooperation, the bellows 211 through 213 generate forces in the rotational directions to extend the first through the third joints of the fingers from their flexed states. The forces generated by the bellows 211 in this manner in the rotational directions to extend the first joints from their flexed states are transmitted to the first joints by the flat plate portions 231*b* and the flat plate portions 232*b*. Moreover, the forces generated by the bellows 212 in the rotational directions to extend the second joints from their flexed states are transmitted to the second joints by the flat plate portions 232*b* and the flat plate portions 233*b*. Furthermore, the forces generated by the bellows 213 in the rotational directions to extend the third joints from their flexed states are transmitted to the third joints by the flat plate portions 233*b* and the flat plate portions 234*b*. As a result, the first through the third joints of the fingers are brought into their extended states from their flexed states.

Furthermore, in this embodiment, the wrist joint motion facilitation part 120 is fitted to the wrist by using a belt member or the like. And, since the annular grooves of the bellows 311 through 313 that oppose the joint are elastically restrained by the elastic members 341 through 343 when the supply of air is performed to the bellows 311 through 313 of the wrist joint motion facilitation part 120 by the air pressure regulation part 180 via the conduit for wrist joint motion 140, accordingly the bellows 311 through 313 are extended into approximately circular arcuate shapes. Due to this, the bellows 311 through 313 generate forces in the rotational direction to flex the joint of the wrist from its extended state. The force generated in this manner by the bellows 311 through 313 in the rotational direction to flex the joint of the wrist from its extended state is transmitted to the joint of the wrist by the flat plate portions such as the flat plate portion 331*b* and so on that are fixed to the back of the hand and by the flat plate portions such as the flat plate portion 332*b* and so on that are fixed to the portion of the forearm near the wrist. As a result, the joint of the wrist is brought to its flexed state.

Next, in a similar manner to the case of wrist joint motion facilitation processing, the air pressure regulation part 180 performs exhausting of air from the bellows 311 through 313. When this exhausting of air from the bellows is performed by the air pressure regulation part 180, the bellows 311 through 313 contract. Due to this, the bellows 311 through 313 generate forces in the rotational direction to extend the joint of the wrist from its flexed state. The force generated in this manner by the bellows 311 through 313 in the rotational direction to extend the joint of the wrist from its flexed state is transmitted to the joint of the wrist by the flat plate portions such as the flat plate portion 331*b* and so on that are fixed to the back of the hand and by the flat plate portions such as the flat plate portion 332*b* and so on that are fixed to the portion of the forearm near the wrist. As a result, the joint of the wrist is brought to its extended state from its flexed state.

Thus, according to this embodiment, along with it being possible to install this device easily upon the fingers and wrist of a human subject, which are predetermined subject portions, also it is possible to facilitate sufficient joint motion for each joint.

[Modification of the Embodiment]

The present invention should not be considered as being limited to the embodiment described above; various alterations may be made therein. For example, in the embodiment described above, by adhering the flat plate portions 234*b* of the finger joint motion facilitation parts $\mathbf{110}_j$ (where j=1, . . . , 5) and the flat plate portions of the transmission members 331, 333, and 335 of the wrist joint motion facilitation part 120 to the mounting sheet 150, it is arranged to fix these flat plate portions upon the back of the hand (refer to FIG. 1 and so on). By contrast, as a variant embodiment of this joint motion facilitation device, it would also be acceptable to arrange to fix these flat plate portions upon the back of the hand with one or more belt members.

Figure 9:
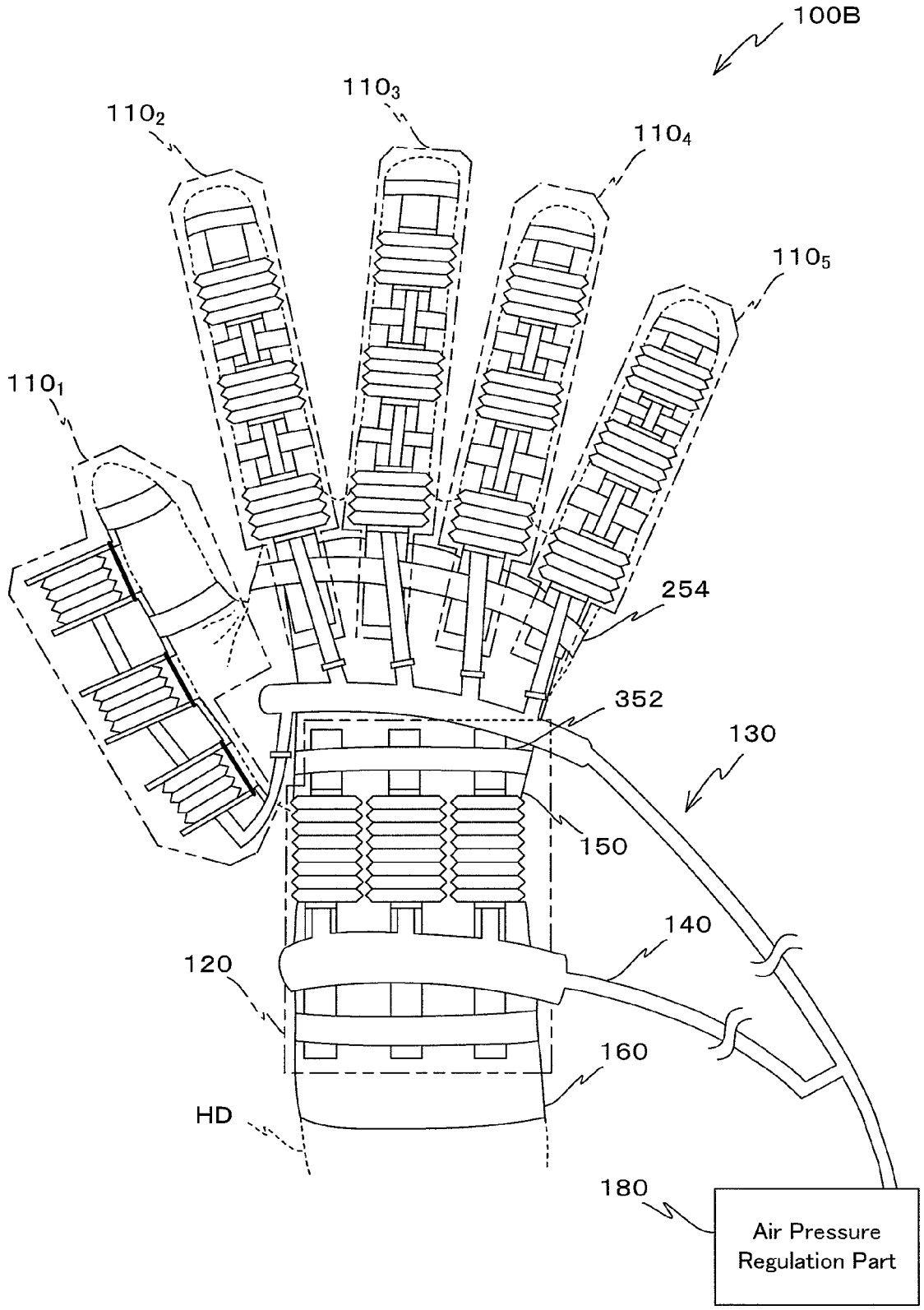
FIG. 9 is a figure for explanation of a first variant embodiment of the finger and wrist joint motion facilitation parts.

FIG. 9 is a figure showing the external appearance of a joint motion facilitation device 100B according to such the first variant embodiment. As shown in FIG. 9, as compared to the joint motion facilitation device 100 of the embodiment described above, this joint motion facilitation device 100B differs by the feature that it is further equipped with belt members 254 and 352. By employing this type of structure, along with the flat plate portions 234*b* of the finger joint motion facilitation parts $\mathbf{110}_j$ being fixed upon the back of the hand near the fingers by the belt member 254 that is made from fabric or from metal, also the flat plate portions of the transmission members 331, 333, and 335 are fixed upon the back of the hand near the wrist by the belt member 352 that is made from fabric or from metal. Furthermore, in the embodiment described above, the joint motion facilitation device was installed upon the fingers and the wrist of the body of a human subject by using belt members and the like (refer to FIG. 1 and so on). By contrast, in a joint motion facilitation device of another variant embodiment, belt members are not used, but rather a glove may be used upon which the bellows connected to the transmission members are disposed in positions corresponding to the joints.

Figure 10:
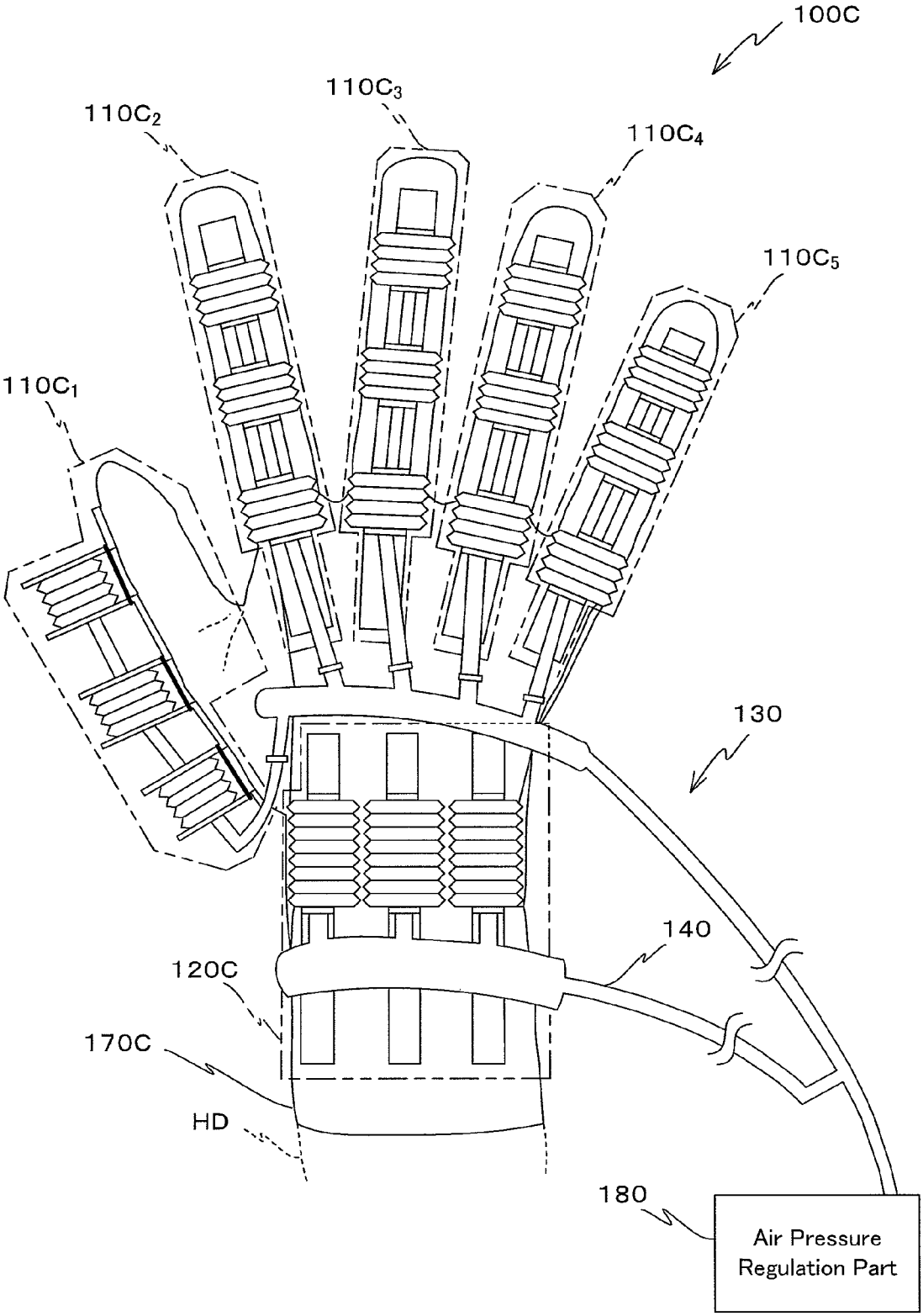
FIG. 10 is a figure for explanation of a second variant embodiment of the finger and wrist joint motion facilitation parts.

FIG. 10 is a figure showing the external appearance of a joint motion facilitation device 100C according to such the second variant embodiment. As shown in FIG. 10, as compared to the joint motion facilitation device 100 of the embodiment described above, this joint motion facilitation device 100C differs by the feature that it is equipped with finger joint motion facilitation parts $\mathbf{110}C_1$ through $\mathbf{1100}_5$ instead of the finger joint motion facilitation parts $\mathbf{110}_1$ through $\mathbf{110}_5$, by the feature that it is equipped with a wrist joint motion facilitation part 120C instead of the wrist joint motion facilitation part 120, by the feature that it is further provided with a glove 170C that functions as a mounting portion, and by the feature that the mounting sheets 150 and 160 are not provided. And, as compared to the finger joint motion facilitation parts $\mathbf{110}_j$ (refer to FIG. 2), each of the finger joint motion facilitation parts $\mathbf{110}C_j$ (where j=1, . . . , 5) of this variant embodiment also differs by the feature that the belt members 251, 252, and 253 are not provided, and by the feature that the transmission members 231 through 234 are adhered to the glove 170C. And, as compared to the wrist joint motion facilitation part 120 (refer to FIG. 3), the wrist joint motion facilitation part 120C described above also differs by the feature that the belt member 351 is not provided, and by the feature that the transmission members 331 through 336 are adhered to the glove 170C.

The transmission members 231 through 234 and 331 through 336 mentioned above are fixed to the glove 170C described above. Due to this, simply by putting the glove 170C onto the body of the human subject, along with the bellows being positioned above the corresponding joint portions in the vertical direction with respect to the axes of rotational motion of the joints, also the transmission members that are connected to the end portions of the bellows are attached to their predetermined subject body portion. It should be understood that while, in the above descriptions of embodiments and variant embodiments, joint motion facilitation devices have been described that facilitate the motions of the joints of the finger and the wrist of the right hand of the body of a human subject, of course it would also be possible to provide a joint motion facilitation device that facilitates the motions of the joints of the finger and the wrist of the left hand.

Furthermore, in the embodiments described above, fifteen bellows are provided for the fingers in order to facilitate the motions of a total of fifteen finger joints. By contrast, it would also be acceptable for the number of finger joints whose motion is to be facilitated to be any number from one to fourteen, and in this case it would be appropriate to provide the same number of bellows as the number of finger joints whose motion is to be facilitated. Moreover while, in the embodiments described above, it was arranged to provide three bellows to the wrist joint motion facilitation part, it would also be acceptable for the number of bellows included in the wrist joint motion facilitation part to be one only.

Yet further while, in the embodiments described above, belt members made from fabric were utilized for installing the joint motion facilitation device upon the fingers and the wrist, it would also be acceptable to arrange to install the joint motion facilitation device upon the fingers and the wrist by employing metallic belts, plastic belts, or wires.

Even further, while it was arranged for the bellows that generate the forces to facilitate the motion of the wrist joint to be disposed on the extension side of the joint, it would also be acceptable to arrange for this bellows to be disposed on the flexion side of the joint, or to be disposed on both the flexion side and the extension side of the joint. If the bellows are disposed on both the flexion side and the extension side of the joint in this manner, then it should be arranged for the air pressure regulation part to perform exhausting of air from the bellows that is disposed on the extension side when performing supply of air to the bellows that is disposed upon the flexion side, and to perform supply of air to the bellows that is disposed on the extension side when performing exhausting of air from the bellows that is disposed upon the flexion side.

It should be understood that while, in the embodiment described above, the bellows that are employed are made from resin and can expand and contract freely and have annular grooves formed at regular intervals, it would also be acceptable to arrange to employ bellows in which the gaps of the annular grooves at regular intervals along the direction of expansion and contraction change continuously around their circumferences. In this case, the sides where the gaps between the annular grooves are shorter should be disposed so as to face the joint portions. And, if such bellows are used, then the elastic members that elastically restrain the annular grooves on the sides of the bellows facing the joints become unnecessary.

It should be understood that, while bellows made from resin are used in the embodiment described above, it would also be acceptable to arrange to employ some other material, provided that it is a material that can expand and contract freely, and moreover with which, when the device is installed upon the body of a human subject, it does not impose a burden greater than necessary due to its weight and so on. Furthermore while, in the embodiment described above, it was arranged for the conduit for finger joint motion to be connected to the bellows 213 of each of the finger joint motion facilitation parts, it would also be acceptable to arrange for such to be connected to each of the bellows 211 through 213 of each of the finger joint motion facilitation parts.

Figure 11:
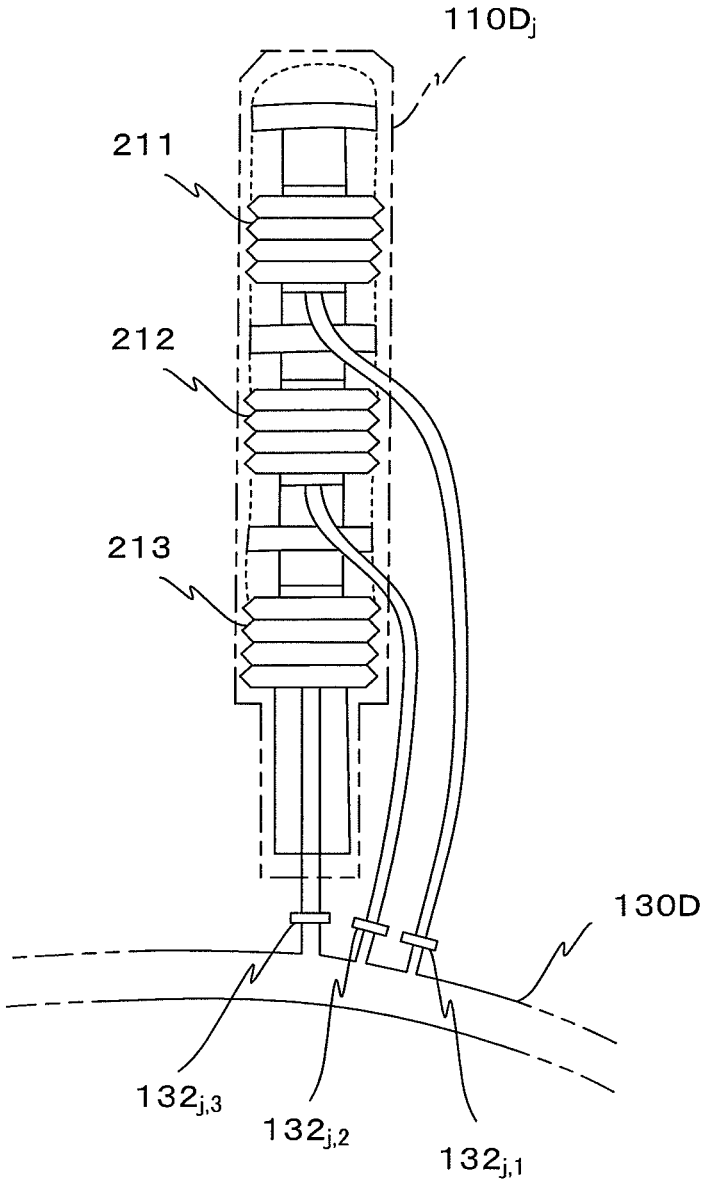
FIG. 11 is a figure for explanation of a third variant embodiment of the finger joint motion facilitation parts.

FIG. 11 is a figure for explanation of the external appearance of the finger joint motion facilitation parts $\mathbf{110}D_j$ (where j=1, . . . , 5) and the conduit for finger joint motion 130D according to such the third variant embodiment. As compared to the finger joint motion facilitation parts $\mathbf{110}_j$ (refer to FIGS. 2A and 2B), the finger joint motion facilitation parts $\mathbf{110}D_j$ mentioned above differ by the feature that the conduits 222 and 223 are not provided, and by the feature that the bellows 211 and 212 and the conduit for finger joint motion 130D are connected together.

As compared to the conduit for finger joint motion 130 (refer to FIG. 4), the conduit for finger joint motion 130D mentioned above differs by the feature that three tubes are connected to each of the bellows 211 through 213, and by the feature that opening and closing valves $\mathbf{132}_{j,1}$, $\mathbf{132}_{j,2}$, and $\mathbf{132}_{j,3}$ are disposed upon the tubes that are connected to each of the bellows 211, 212, and 213.

With this structure, by operating the opening and closing valves $\mathbf{132}_{j,1}$ through $\mathbf{132}_{j,3}$, it is possible to facilitate the flexing and extending motion of any of the joints. For example, in order to facilitate the flexion and extension motion of only the first joint, it is appropriate to open the opening and closing valve $\mathbf{132}_{j,1}$ while closing the opening and closing valves $\mathbf{132}_{j,2}$ and $\mathbf{132}_{j,3}$. Moreover, in order to facilitate the flexion and extension motion of only the second joint, it is appropriate to open the opening and closing valve $\mathbf{132}_{j,2}$ while closing the opening and closing valves $\mathbf{132}_{j,1}$ and $\mathbf{132}_{j,3}$. And, in order to facilitate the flexion and extension motion of only the third joint, it is appropriate to open the opening and closing valve $\mathbf{132}_{j,3}$ while closing the opening and closing valves $\mathbf{132}_{j,1}$ and $\mathbf{132}_{j,2}$. Furthermore, if motion of all of the joints of the finger is to be facilitated, then it would be acceptable to arrange to omit the opening and closing valves.

It should be understood that in the embodiment described above the method of changeover control of supply and exhausting of air to and from the bellows (refer to FIG. 6) is only one example; it would of course be acceptable to employ some other control method.

Furthermore while, in the embodiment described above, the air pressure regulation part included the pressure tank, the vacuum tank, the electrical air pressure control valve, the control part, and so on (refer to FIG. 5), it would also be acceptable to employ some other structure. For example, it would be acceptable for the air pressure regulation part to be constructed to include a rotary vane type air pump, a control part, and so on. In this case it would be arranged for the air pump to perform supply of air to the bellows and exhausting of air from the bellows, under control by the control part. Moreover, it would also be acceptable to build the air pressure regulation part to include a manual reciprocating pump such as a manual piston pump or a manual bellows pump or the like, that can perform supply of air to the bellows and exhausting of air from the bellows.

Moreover while, in the embodiment described above, it was arranged to provide the air pressure regulation part that performed supply of air to the bellows and exhausting of air from the bellows, it would also be possible to arrange to omit the pressure regulation part, if the adjustment of the air pressure in the bellows is performed by exhaling or inhaling the breath. Furthermore, while in the embodiment described above the joint motion facilitation device was described which facilitates the motion of the joints of the finger and the wrist of the body of a human subject, it would also be possible to provide a device that facilitates only the motion of the joints of the fingers, or a device that facilitates only the motion of the joint of the wrist.

And while, in the embodiment described above, it was arranged for the transmission members to be adhered to the bellows, it would also be acceptable to arrange for them to be attachable to the bellows and detachable therefrom. In this case, by preparing transmission members that are matched to the lengths of the distances between the joints of the user (i.e. of the patient) and so on, it is possible to provide a device that is matched to the skeleton and so on of that user (i.e. of that patient). Furthermore while, in the embodiment described above, bio-monitoring signals such as an electromyogram, the hardness of the muscles, and so on was used as the bio-monitoring information related to the muscles that drive the joints, it would also be acceptable to employ electroencephalograms of the user as this bio-monitoring information. Furthermore while, in the embodiment described above, the joint motion facilitation device that facilitates the motion of the joints of the fingers and the wrist of the body of a human subject, was described, it would also be acceptable to provide a device that facilitates the motion of some other joint or joints.

<Facilitation of Motion of the Elbow Joint>

Figure 12A:
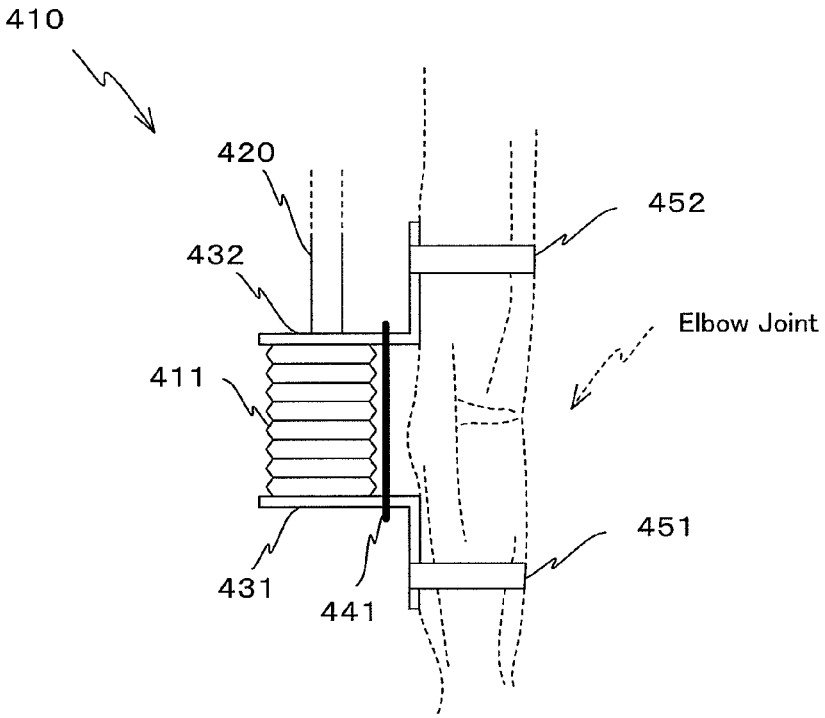
FIG. 12A is a figure for explanation of the state of an elbow joint motion facilitation part which is a variant embodiment, when the air pressure in a bellows thereof has been lowered.
Figure 12B:
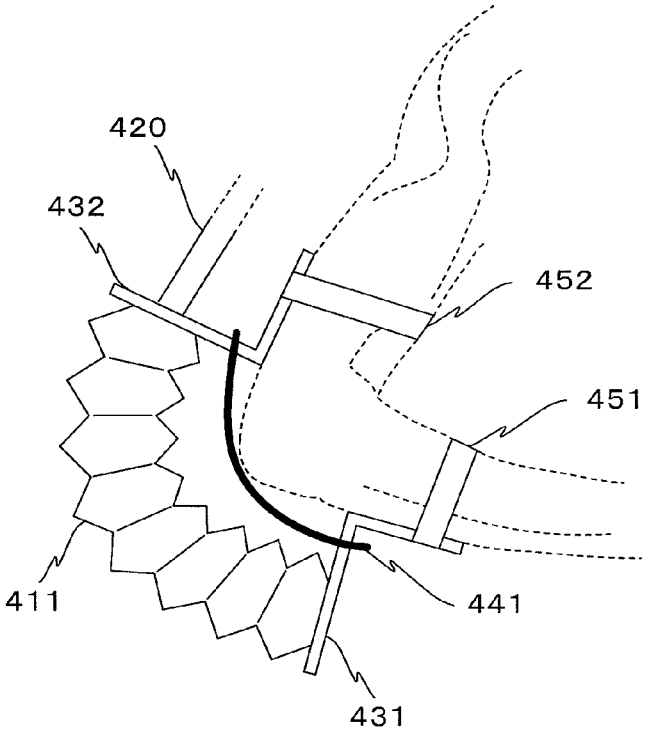
FIG. 12B is a figure for explanation of the state of this elbow joint motion facilitation part which is a variant embodiment, when the air pressure in the bellows thereof has been elevated.

If, for example, the motion of the elbow joint is to be facilitated, then an elbow joint motion facilitation part 410 having the overall external appearance shown in FIGS. 12A and 12B may be provided. This elbow joint motion facilitation part 410 comprises a bellows 411, a conduit 420, and transmission members 431 and 432. Moreover, the elbow joint motion facilitation part 410 comprises an elastic member 441 that serves as a restraining member, and belt members 451 and 452 that serve as fastening members. Similarly to the bellows in the embodiments described above, the bellows 411 mentioned above is a member that has annular grooves at regular intervals and can expand and contract freely, and is disposed on the extension side of the joint of the elbow. And one end of the conduit 420 described above is connected to the bellows 411, while its other end is connected to an air pressure regulation part not shown in the figures.

Like the transmission members of the embodiments described above, the transmission members 431 and 432 described above are made by folding long flat metallic plates along folding lines that are perpendicular to their longitudinal directions into letter-L shapes. Here, the transmission member 431 is formed to have two flat plate portions, with one of these flat plate portions being adhered to one end of the bellows 411 in its expansion and contraction direction and the other of these flat plate portions being mounted upon the forearm of the user and being fixed thereto by the belt member 451. Similarly, the transmission member 432 is formed to have two flat plate portions, with one of these flat plate portions being adhered to the other end of the bellows 411 in its expansion and contraction direction and the other of these flat plate portions being mounted upon the upper arm of the user and being fixed thereto by the belt member 452.

Here, FIG. 12A shows the state of the elbow joint motion facilitation part 410 when the air pressure in the bellows 411 has been lowered and the internal pressure in the bellows has attained a sufficiently low negative pressure level. At this time, the bellows 411 generates a force in the rotational direction to extend the elbow joint from its flexed state, and this force is transmitted to the transmission members 431 and 432. As a result, the elbow joint is brought to its extended state. Moreover, FIG. 12B shows the state of the elbow joint motion facilitation part 410 when the air pressure in the bellows 411 has been raised and the internal pressure in the bellows has attained a sufficiently high positive pressure level. At this time, the bellows 411 generates a force in the rotational direction to flex the elbow joint from its extended state, and this force is transmitted to the transmission members 431 and 432. As a result, the elbow joint is brought to its flexed state.

It should be understood that while, in FIGS. 12A and 12B, it was arranged for the bellows to be disposed on the extension side of the elbow joint, it would also be acceptable to arrange for this bellows to be disposed on the flexion side of the elbow joint, or to arrange for bellows to be provided on both the flexion side and also the extension side.

<Facilitation of Motion of the Hip Joint>

Figure 13A:
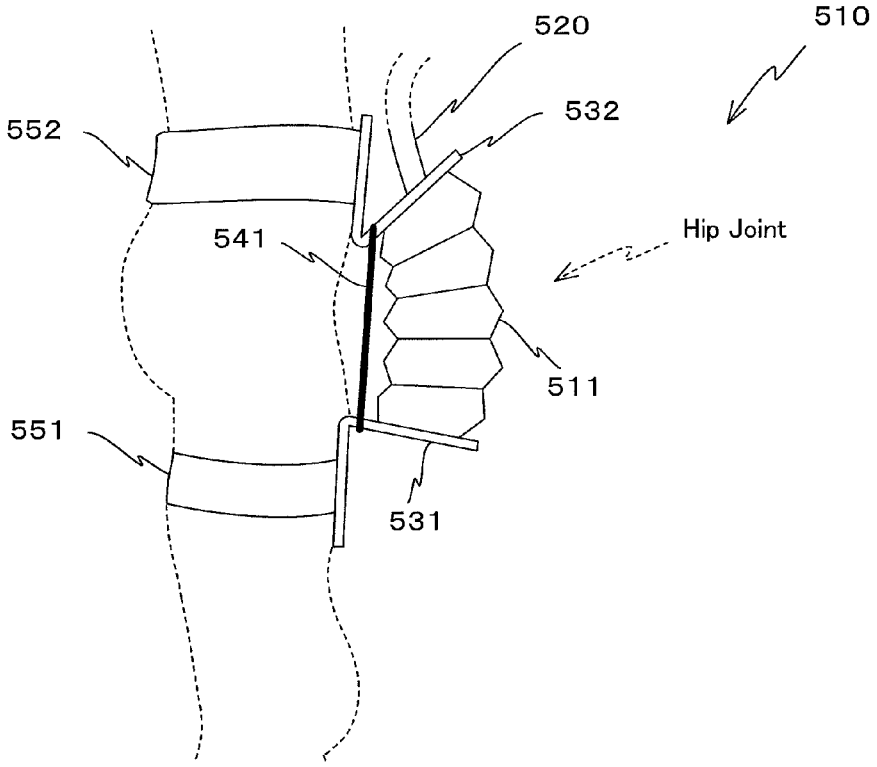
FIG. 13A is a figure for explanation of the state of a hip joint motion facilitation part which is a variant embodiment, when the air pressure in a bellows thereof has been elevated.
Figure 13B:
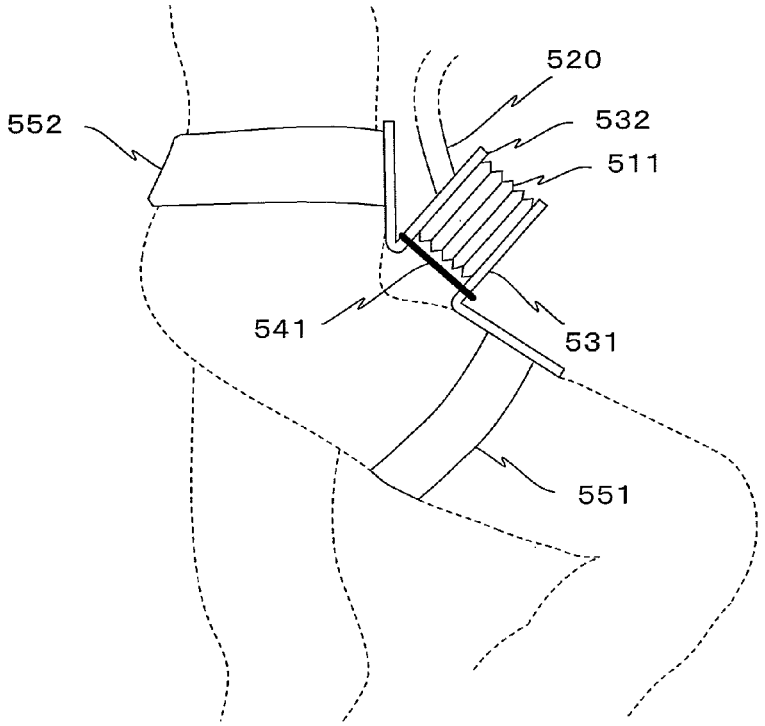
FIG. 13B is a figure for explanation of the state of this hip joint motion facilitation part which is a variant embodiment, when the air pressure in the bellows thereof has been lowered.

And, if the motion of the hip joint is to be facilitated, then, for example, a hip joint motion facilitation part 510 having the overall external appearance shown in FIGS. 13A and 13B may be provided. This hip joint motion facilitation part 510 comprises a bellows 511, a conduit 520, and transmission members 531 and 532. Moreover, the hip joint motion facilitation part 510 comprises an elastic member 541 that serves as a restraining member, and belt members 551 and 552 that serve as fastening members.

The bellows 511 described above is disposed on the flexion side of the hip joint. And one end of the above described conduit 520 is connected to the bellows 511, while the other end thereof is connected to an air pressure regulation part not shown in the figures. Each of the transmission members 531 and 532 described above is made by folding a long flat metallic plate along a folding line that is perpendicular to its longitudinal directions. In this variant embodiment, the folding angle of the transmission member 531 is set to be (80±10)°, while the folding angle of the transmission member 532 is set to be (45±10)°. And these angles may be adjusted so as to be appropriate in consideration of the range of movement of the hip joint of the user for performing rehabilitation, and so on. It should be understood that this folding angle corresponds to the physical structure of the user, the degree of contracture of the joint, and so on, and of course it would be acceptable to arrange to employ angles other than those described above.

The transmission member 531 is formed to have two flat plate portions, with one of these flat plate portions being adhered to one end of the bellows 511 in its expansion and contraction direction and the other of these flat plate portions being mounted upon the thigh of the user and being fixed thereto by the belt member 551. Moreover, the transmission member 532 is formed to have two flat plate portions, with one of these flat plate portions being adhered to the other end of the bellows 511 in its expansion and contraction direction and the other of these flat plate portions being mounted upon the abdomen of the user and being fixed thereto by the belt member 552. In this variant embodiment, in order to transmit the force generated by the bellows 511 to the soft abdomen with good efficiency, the belt member 552 that is wound around the abdomen and attached thereto is made by processing for forming a resin that hardens at normal temperature into the shape of a belt. It should be understood that the material for this belt member 552 could, of course, be some other type of material, provided that it is a material that can transmit the force generated by the bellows 511 to the abdomen with good efficiency.

It should be understood that, in this variant embodiment, in addition to the function of the air pressure regulation part 180 described above, the air pressure regulation part is also capable of performing control to communicate the end portion of the conduit 520 connected to the air pressure regulation part with the external atmosphere. And, when facilitating motion of the hip joint during rehabilitation in a supine posture, in a similar manner to the case with the embodiment described above, this air pressure regulation part regulates the pressure in the bellows 511 by repeatedly performing supply of air to the bellows 511 and exhaustion of air from the bellows 511. On the other hand, when facilitating walking, it is arranged for this air pressure regulation part to regulate the air pressure by repeatedly performing exhaustion of air from the bellows 511 and opening of the space within the bellows 511 to the ambient atmosphere.

FIG. 13A shows the state of the bellows when the hip joint has been brought to its extended state. In other words, in the case of rehabilitation in a supine posture, FIG. 13A shows the state of the hip joint motion facilitation part 510 when, due to positive and active supply of air to the interior of the bellows 511, the air pressure within the bellows 511 has been elevated and the bellows internal pressure has become positive. At this time, the bellows 511 generates force in the rotational direction to extend the hip joint from its flexed state, and this force is transmitted to the transmission members 531 and 532. As a result, the hip joint is brought to its extended state. Moreover, when facilitating walking, FIG. 13A shows the state of the hip joint motion facilitation part 510 when the space within the bellows has been opened to the external atmosphere. At this time, it is arranged for the hip joint to go into its extended state due to the weight of the leg.

And FIG. 13B shows a state of the hip joint motion facilitation part 510 that is common both to the case of facilitating hip joint motion during rehabilitation in a supine posture and also to the case of facilitating walking, in which the air pressure in the bellows 511 is lowered, and the internal pressure in the bellows has attained a sufficiently low negative pressure level. At this time, the bellows 511 generates force in the rotational direction to flex the hip joint from its extended state, and this force is transmitted to the transmission members 531 and 532. As a result, the elbow joint is brought to its flexed state.

<Facilitation of Motion of the Knee Joint>

Figure 14A:
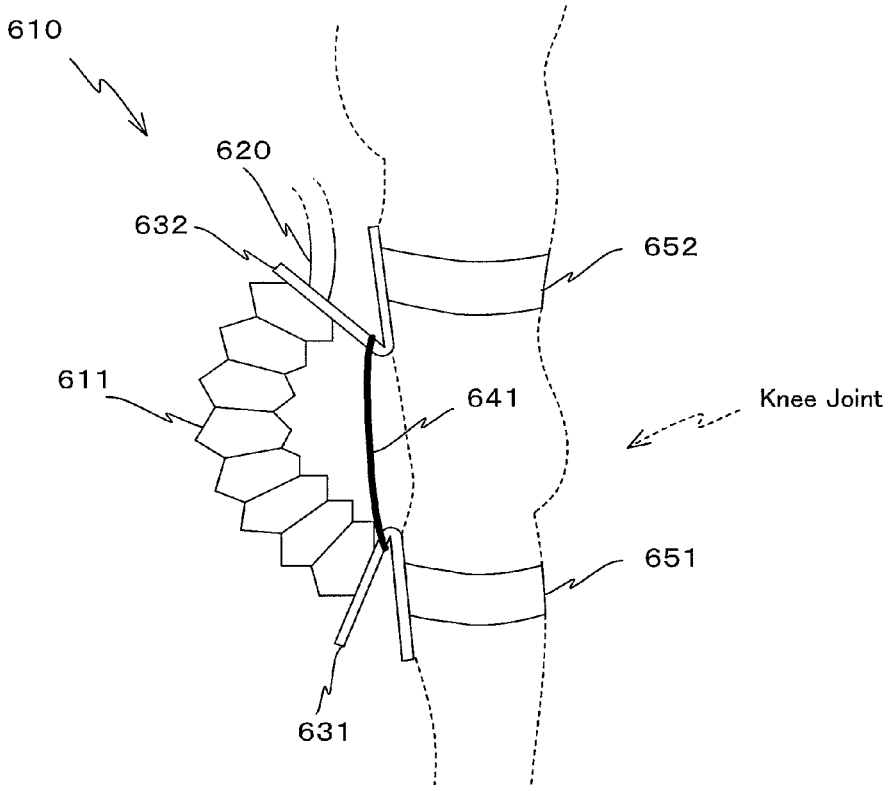
FIG. 14A is a figure for explanation of the state of a knee joint motion facilitation part which is a variant embodiment, when the air pressure in a bellows thereof has been elevated.
Figure 14B:
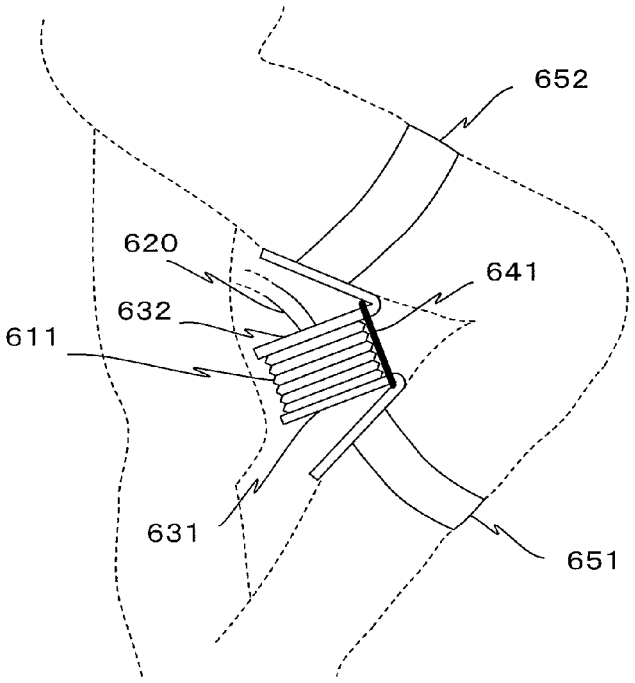
FIG. 14B is a figure for explanation of the state of this knee joint motion facilitation part which is a variant embodiment, when the air pressure in the bellows thereof has been lowered.

And, if the motion of the knee joint is to be facilitated, then, for example, a knee joint motion facilitation part 610 having the overall external appearance shown in FIGS. 14A and 14B may be provided. This knee joint motion facilitation part 610 comprises a bellows 611, a conduit 620, and transmission members 631 and 632. Moreover, the knee joint motion facilitation part 610 comprises an elastic member 641 that serves as a restraining member, and belt members 651 and 652 that serve as fastening members.

The bellows 611 described above is disposed on the flexion side of the knee joint. And one end of the above described conduit 620 is connected to the bellows 611, while the other end thereof is connected to an air pressure regulation part not shown in the figures. Each of the transmission members 631 and 632 described above is made by folding a long flat metallic plate along a folding line that is perpendicular to its longitudinal directions. In this variant embodiment, the folding angle of the transmission member 631 is set to be (30±10)°, while the folding angle of the transmission member 632 is set to be (45±10)°. And these angles may be adjusted so as to be appropriate in consideration of the range of movement of the knee joint of the user for performing rehabilitation, and so on. It should be understood that this folding angle corresponds to the physical structure of the user, the degree of contracture of the joint, and so on, and of course it would be acceptable to arrange to employ angles other than those described above.

The transmission member 631 is formed to have two flat plate portions, with one of these flat plate portions being adhered to one end of the bellows 611 in its expansion and contraction direction and the other of these flat plate portions being mounted upon the lower leg of the user and being fixed thereto by the belt member 651. Moreover, the transmission member 632 is formed to have two flat plate portions, with one of these flat plate portions being adhered to the other end of the bellows 611 in its expansion and contraction direction and the other of these flat plate portions being mounted upon the thigh of the user and being fixed thereto by the belt member 652.

Here, FIG. 14A shows the state of the knee joint motion facilitation part 610 when the air pressure in the bellows 611 has been elevated, and the bellows internal pressure has reached a sufficiently high positive level. At this time, the bellows 611 generates force in the rotational direction to extend the knee joint from its flexed state, and this force is transmitted to the transmission members 631 and 632. As a result, the knee joint is brought to its extended state. Moreover, FIG. 14B shows the state of the knee joint motion facilitation part 610 when the air pressure in the bellows 611 is lowered, and the internal pressure in the bellows has attained a sufficiently low negative pressure level. At this time, the bellows 611 generates force in the rotational direction to flex the knee joint from its extended state, and this force is transmitted to the transmission members 631 and 632. As a result, the knee joint is brought to its flexed state. It should be understood that while, in FIGS. 14A and 14B, it was arranged for the bellows to be disposed on the flexion side of the knee joint, it would also be acceptable to arrange for this bellows to be disposed on the extension side of the knee joint, or to arrange for bellows to be provided on both the flexion side and also the extension side of the knee joint.

<Facilitation of Motion of the Ankle Joint>

Figure 15A:
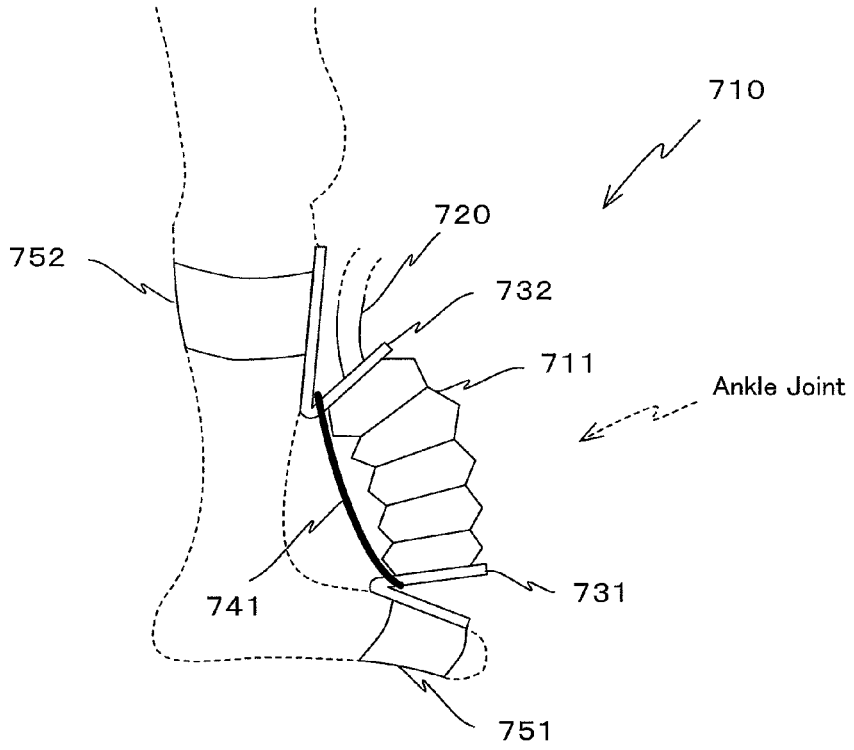
FIG. 15A is a figure for explanation of an ankle joint motion facilitation part which is a variant embodiment (the first part thereof), when the air pressure in a bellows thereof has been elevated.
Figure 15B:
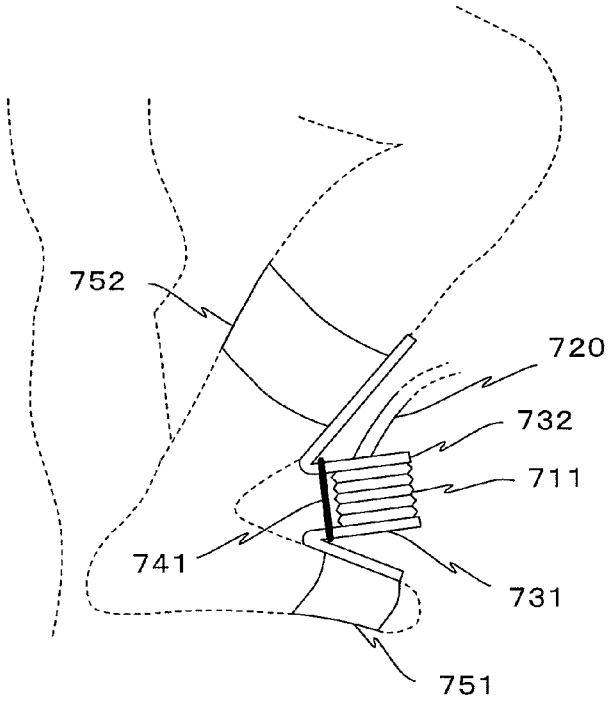
FIG. 15B is a figure for explanation of this ankle joint motion facilitation part which is a variant embodiment (the first part thereof), when the air pressure in the bellows has been lowered.

Furthermore, if the motion of the ankle joint is to be facilitated, then, for example, an ankle joint motion facilitation part 710 having the overall external appearance shown in FIGS. 15A and 15B may be provided. This ankle joint motion facilitation part 710 comprises a bellows 711, a conduit 720, and transmission members 731 and 732. Moreover, the ankle joint motion facilitation part 710 comprises an elastic member 741 that serves as a restraining member, and belt members 751 and 752 that serve as fastening members.

The bellows 711 described above is disposed on the flexion side of the ankle joint. And one end of the above described conduit 720 is connected to the bellows 711, while the other end thereof is connected to an air pressure regulation part not shown in the figures. Each of the transmission members 731 and 732 described above is made by folding a long flat metallic plate along a folding line that is perpendicular to its longitudinal directions. In this variant embodiment, the folding angle of the transmission member 731 is set to be (30±10)°, while the folding angle of the transmission member 732 is set to be (45±10)°. And these angles may be adjusted so as to be appropriate in consideration of the range of movement of the ankle joint of the user for performing rehabilitation, and so on. It should be understood that this folding angle corresponds to the physical structure of the user, the degree of contracture of the joint, and so on, and of course it would be acceptable to arrange to employ angles other than those described above.

The transmission member 731 is formed to have two flat plate portions, with one of these flat plate portions being adhered to one end of the bellows 711 in its expansion and contraction direction and the other of these flat plate portions being mounted upon the foot of the user near the base of his toes and being fixed thereto by the belt member 751. Moreover, the transmission member 732 is formed to have two flat plate portions, with one of these flat plate portions being adhered to the other end of the bellows 711 in its expansion and contraction direction and the other of these flat plate portions being mounted upon the shin of the user and being fixed thereto by the belt member 752.

Here, FIG. 15A shows the state of the ankle joint motion facilitation part 710 when the air pressure in the bellows 711 has been elevated, and the bellows internal pressure has reached a sufficiently high positive level. At this time, the bellows 711 generates force in the rotational direction to extend the ankle joint from its flexed state, and this force is transmitted to the transmission members 731 and 732. As a result, the ankle joint is brought to its extended state. Moreover, FIG. 15B shows the state of the ankle joint motion facilitation part 710 when the air pressure in the bellows 711 is lowered, and the internal pressure in the bellows 711 has attained a sufficiently low negative pressure level. At this time, the bellows 711 generates force in the rotational direction to flex the ankle joint from its extended state, and this force is transmitted to the transmission members 731 and 732. As a result, the ankle joint is brought to its flexed state.

Figure 16A:
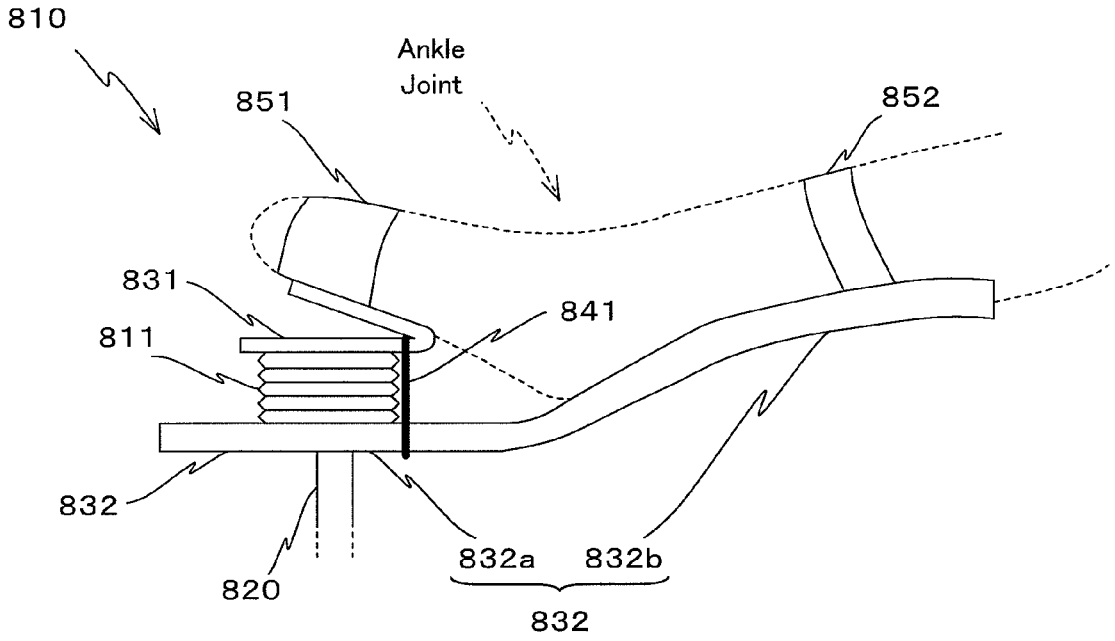
FIG. 16A is a figure for explanation of an ankle joint motion facilitation part which is a variant embodiment (the second part thereof), when the air pressure in a bellows thereof has been lowered.
Figure 16B:
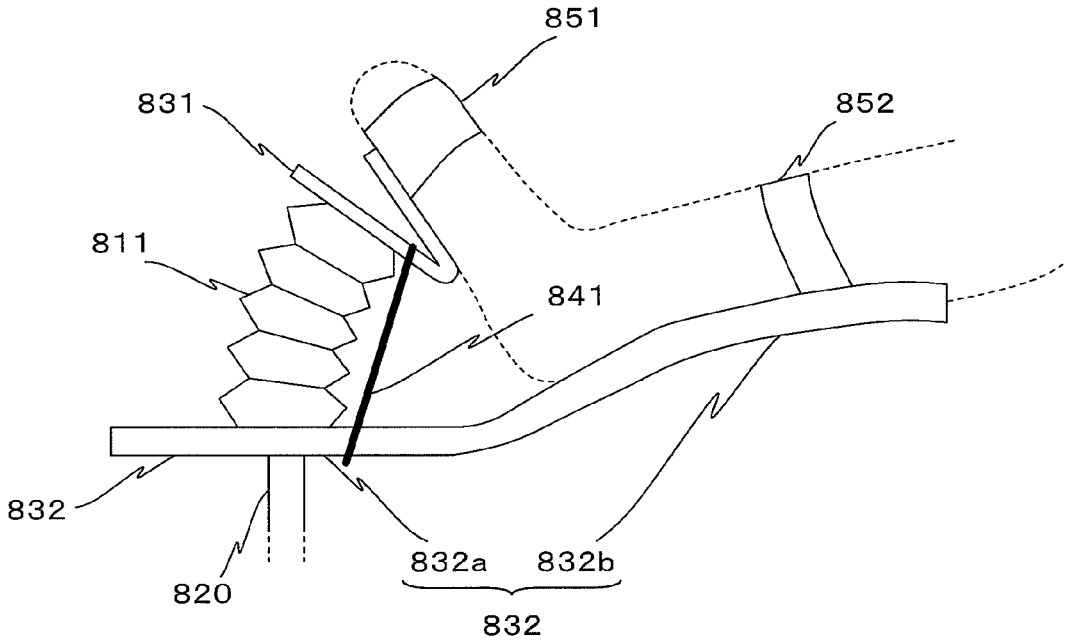
FIG. 16B is a figure for explanation of this ankle joint motion facilitation part which is a variant embodiment (the second part thereof), when the air pressure in the bellows has been elevated.

Furthermore, if the motion of the ankle joint is to be facilitated, then, for example, an ankle joint motion facilitation part 810 having the overall external appearance shown in FIGS. 16A and 16B may also be provided. This ankle joint motion facilitation part 810 comprises a bellows 811, a conduit 820, and transmission members 831 and 832. Moreover, the ankle joint motion facilitation part 810 comprises an elastic member 841 that serves as a restraining member, and belt members 851 and 852 that serve as fastening members. The bellows 811 described above is disposed on the extension side of the ankle joint. And one end of the above described conduit 820 is connected to the bellows 811, while the other end thereof is connected to an air pressure regulation part not shown in the figures. The transmission members 831 described above is made by folding a long flat metallic plate along a folding line that is perpendicular to its longitudinal directions. And the transmission member 832 described above is made as shown in the figure, so as to be adapted to the range of movement required by the ankle joint for facilitating its flexion and extension motion.

The transmission member 831 is formed to have two flat plate portions, with one of these flat plate portions being adhered to one end of the bellows 811 in its expansion and contraction direction and the other of these flat plate portions being mounted upon the bottom of the foot of the user and being fixed thereto by the belt member 851. Moreover, the transmission member 832 is formed to have two transmission portions 832*a* and 832*b*, with one of these transmission portions 832*a* being adhered to the other end of the bellows 811 in its expansion and contraction direction and the other of these transmission portions 832*b* being mounted upon the calf of the user and being fixed thereto by the belt member 852.

Here, FIG. 16A shows the state of the ankle joint motion facilitation part 810 when the air pressure in the bellows 811 has been lowered, and the bellows internal pressure has reached a sufficiently low negative level. At this time, the bellows 811 generates force in the rotational direction to extend the ankle joint from its flexed state, and this force is transmitted to the transmission members 831 and 832. As a result, the ankle joint is brought to its extended state. Moreover, FIG. 16B shows the state of the ankle joint motion facilitation part 810 when the air pressure in the bellows 811 is raised, and the internal pressure in the bellows 811 has attained a sufficiently high positive pressure level. At this time, the bellows 811 generates force in the rotational direction to flex the ankle joint from its extended state, and this force is transmitted to the transmission members 831 and 832. As a result, the ankle joint is brought to its flexed state.

It should be understood that while in FIGS. 15A and 15B it was arranged for the bellows to be disposed on the flexion side of the ankle joint, and in FIGS. 16A and 16B it was arranged for the this bellows to be disposed on the extension side of the ankle joint, alternatively, it would be acceptable to arrange for bellows to be provided on both the flexion side and also the extension side of the ankle joint.

Furthermore, while in FIGS. 12A and 12B to 16A and 16B only one bellows was shown, it would also be acceptable to arrange to use a plurality of bellows linked together. Moreover, it would also be acceptable to adapt this joint motion facilitation device so that it facilitates the motion of the shoulder. In this case, it would be acceptable to arrange to dispose the bellows that generates force for facilitating joint motion on the flexion side of the shoulder joint, or on the extension side thereof; or it would also be acceptable to arrange to dispose bellows on both the flexion side and the extension side of the shoulder joint.

Even further, the joint motion facilitation device of the present invention can be utilized, not only as a device for rehabilitation, but also as a device for power assistance that helps the body of a human subject, for example a subject whose grip is weak. In particular, if the present invention is utilized as a device for power assistance, then it would be acceptable to detect an electromyogram, the hardness of the muscles, an electroencephalogram, or the like as the bio-monitoring information related to the muscle that drives the joint, to derive the force that the muscle is producing from the result of this detection, and to determine the air pressure or the like when performing supply of air to the bellows and/or exhausting of air from the bellows on the basis of the result of this derivation.

Yet further, while the operation fluid of the joint motion facilitation device of the present invention was taken as being air, it would also be acceptable for it to be a liquid such as water or hydraulic fluid or the like. Still further, while in the embodiments described above the present invention was applied to a joint motion facilitation device for facilitating the motion of a joint of the body of a human subject, it would also be possible to apply the present invention to a joint motion facilitation device that facilitates the motion of the joint of a predetermined subject body portion having a joint mechanism other than the body of a human subject, such as a mammal or a robot or the like.

As has been explained above, in the fields of medical treatment and nursing and so on, the present invention can be applied to a joint motion facilitation device that facilitates joint motion of various predetermined subject body portions.

What is claimed is:

1. A joint motion facilitation device that facilitates the motion of one or more joints of a predetermined subject body portion, each joint having a rotational axis of rotation motion, comprising:

at least one bellows that can expand and contract freely, provided for each joint in said predetermined subject body portion for which joint motion is to be facilitated, and generating force to facilitate said joint motion when provided to a joint portion in a direction perpendicular with respect to the rotational axis of rotation motion of said joint, and at a side of a rotational motion direction of said joint for which joint motion is to be facilitated;

a conduit that communicates with said bellows to provide operation fluid to said bellows at a regulated pressure to obtain an internal bellows pressure;

transmission members connected to end portions of said bellows, that, when mounted to said predetermined subject body portion, transmit force originating in expansion and contraction of said bellows to said joint for facilitating said joint motion, wherein said transmission members connected to a single bellow are a different shape than said transmission members connected to a plurality of bellows; and mounting portions that mount said bellows and said transmission members to said predetermined subject body portion, wherein said bellows generates force to facilitate said joint motion which causes by the contraction of the bellows, when exhausting of operation fluid from said bellows is performed, so that the internal bellows pressure has attained a negative pressure level.

2. A joint motion facilitation device according to claim 1, wherein said operation fluid is air, and said device further comprising an air pressure regulation part that regulates said air pressure in the bellows via said conduit.

3. A joint motion facilitation device according to claim 2, wherein said air pressure regulation part performs supply of air to said bellows and exhaustion of air from said bellows.

4. A joint motion facilitation device according to claim 2, further comprising:

a detection part that detects bio-monitoring information related to a muscle that drives said joint, and said air pressure regulation part that regulates the air pressure in said bellows on the basis of the detected bio-monitoring information by said detection part.

5. A joint motion facilitation device according to claim 1, wherein annular grooves are provided at regular intervals along an expansion and contraction direction upon said bellows, and said device further comprising a restraining member that elastically restraints the interval of the annular grooves on a side of said bellows that faces said joint.

6. A joint motion facilitation device according to claim 1, wherein on said bellows, annular grooves are provided at regular intervals along an expansion and contraction direction thereof and a distance between the annular grooves changes continuously around a circumferential direction thereof, and said distance between said annular grooves is shorter on a side of the bellows that faces said joint portion.

7. A joint motion facilitation device according to claim 1, wherein said transmission members are fittable to and detachable from said bellows.

8. A joint motion facilitation device according to claim 1, wherein:

said joints of said predetermined subject body portion are at least a single joint of a finger; and said bellows is disposed upon an extension side of said joint.

9. A joint motion facilitation device according to claim 8, wherein bellows that are provided for each of a plurality of joints of the same finger operate together, and simultaneously generate forces in a first rotational direction directed from a flexed state to an extended state, or simultaneously generate forces in a second rotational direction directed from the extended state to the flexed state.

10. A joint motion facilitation device according to claim 8, wherein a plurality of said bellows are provided, and said device further comprising a selection part that selects bellows, among said plurality of bellows, whose operational fluid pressure can be regulated.

11. A joint motion facilitation device according to claim 1, wherein:

said joint of said predetermined subject body portion is a wrist joint, and said bellows is disposed upon at least one of a flexion side and an extension side of said wrist joint.

12. A joint motion facilitation device according to claim 8, wherein said mounting portion is a glove upon which said bellows that is connected to said transmission members is disposed at a position corresponding to said joint.

13. A joint motion facilitation device according to claim 1, wherein:

said joint of said predetermined subject body portion is at least one of an elbow joint, a shoulder joint, a knee joint, and an ankle joint, and said bellows is disposed upon at least one of a flexion side and an extension side of said at least one joint.

14. A joint motion facilitation device according to claim 1, wherein:

said joint of said predetermined subject body portion is a hip joint, and said bellows is disposed upon a flexion side of said hip joint.

15. A joint motion facilitation device according to claim 1, wherein said mounting portion comprises a fastening member that is disposed to said transmission member and that is fastened around said predetermined subject body portion.

16. A joint motion facilitation device according to claim 1, wherein said transmission members connected to a single bellow are substantially L shaped.

17. A joint motion facilitation device according to claim 1, wherein said transmission members connected to a plurality of bellow are substantially U shaped.

18. A joint motion facilitation device that facilitates the motion of one or more joints of a predetermined subject body portion, each joint having a rotational axis of rotation motion, comprising:

at least one bellows that can expand and contract freely, provided for each joint in said predetermined subject body portion for which joint motion is to be facilitated, and generating force to facilitate said joint motion when provided to a joint portion in a direction perpendicular with respect to the rotational axis of rotation motion of said joint, and at a side of a rotational motion direction of said joint for which joint motion is to be facilitated;

a conduit that communicates with said bellows to provide operation fluid to said bellows at a regulated pressure to obtain an internal bellows pressure;

transmission members connected to end portions of said bellows, that, when mounted to said predetermined subject body portion, transmit force originating in expansion and contraction of said bellows to said joint for facilitating said joint motion, wherein said transmission members connected to a single bellow are a different shape than said transmission members connected to a plurality of bellows;

a restraining member that elastically restraints the interval of annular grooves on a side of said bellows, facing said side to said joint; and mounting portions that mount said bellows and said transmission members to said predetermined subject body portion, wherein said transmission members comprise a one-side-transmission-member adapted to be mounted to a one side body part of said predetermined subject body portion, said one side body part being connected to said joint, and an other-side-transmission-member adapted to be mounted to an other side body part of said predetermined subject body portion, said other side body part being connected to said joint, whereby said restraining member is fitted over a portion near said joint of said one-side-transmission-member and a portion near said joint of said other-side-transmission-member, said annular grooves are provided at regular intervals along an expansion and contraction direction upon said bellows, said bellows generates force to facilitate said joint motion which causes by the contraction of the bellows, when the internal bellows pressure has attained a negative pressure level by exhausting of operation fluid from said bellows.

19. A joint motion facilitation device according to claim 18, wherein said transmission members connected to a single are being substantially L shaped.

20. A joint motion facilitation device according to claim 18, wherein said transmission members connected to a plurality of bellow are substantially U shaped.

* * * * *